US008280783B1

(12) United States Patent
Brownell et al.

(10) Patent No.: US 8,280,783 B1
(45) Date of Patent: Oct. 2, 2012

(54) METHOD AND SYSTEM FOR PROVIDING MULTI-LEVEL TEXT CLOUD NAVIGATION

(75) Inventors: Jeffrey T. Brownell, Seattle, WA (US); John D. Rodgers, Seattle, WA (US); Christel C. Berg, Seattle, WA (US)

(73) Assignee: Amazon Technologies, Inc., Reno, NV (US)

( * ) Notice: Subject to any disclaimer, the term of this patent is extended or adjusted under 35 U.S.C. 154(b) by 1385 days.

(21) Appl. No.: 11/862,700
(22) Filed: Sep. 27, 2007

(51) Int. Cl.
*G06Q 30/00* (2006.01)
(52) U.S. Cl. ..... 705/27.1; 705/26.1; 705/26.7
(58) Field of Classification Search ..... 705/27, 705/26
See application file for complete search history.

(56) References Cited

U.S. PATENT DOCUMENTS

| | | | | |
|---|---|---|---|---|
| 6,029,172 | A * | 2/2000 | Jorna et al. | 1/1 |
| 6,785,671 | B1 * | 8/2004 | Bailey et al. | 705/26.81 |
| 7,548,909 | B2 * | 6/2009 | Rappaport et al. | 1/1 |
| 2005/0060304 | A1 * | 3/2005 | Parikh | 707/3 |
| 2005/0222987 | A1 * | 10/2005 | Vadon | 707/3 |
| 2006/0195442 | A1 * | 8/2006 | Cone et al. | 707/5 |
| 2008/0092044 | A1 * | 4/2008 | Lewis et al. | 715/713 |

OTHER PUBLICATIONS

Crosman, Penny: "Search in Focus—Search engines don't know the difference between reading glasses and drinking glasses, . . . ," Intelligent Enterprise Dec. 2006; Proquest #1173763611, 9 pgs.*
Marquilius, David: "Putting Flickr in the enterprise picture," CIO Canada, v15i51, Jun. 2007; Proquest #1316251961, 2pgs.*
Spanbauer, Scott: "New, Improved WEB," PC World, Feb. 2006, v24i2; Proquest #973258241, 15pgs.*
ZoomTags website: Internet Archive Wayback Machine, www.archive.org; www.zoomtags.com, Aug. 2007; 4pgs.*
Macgregor et al.: "Collaborative tagging as a knowledge organisation and resource discovery tool," Library Review, 2006, v55i5; Proquest #1127249491, 11pgs.*
Breeding, Marshall: "An Industry Redefined," Library Journal, Apr. 1, 2007, v132i6; Proquest #1249108421, 24pgs.*
"Clusty.com Becomes Official Home of Vivisimo Search Innovation," Business Wire, Oct. 2, 2006; Proquest #1139117131, 3pgs.*
Gordon-Mumane, Laura: Socal Bookmarking, Folksonomies, and Web 2.0 Tools,: Searcher, Jun. 2006, v14i6; Proquest #1061344611, 14pgs.*
Bulik, Beth Snyder: "Media Morph Tag Clouds," Advertising Age, Jul. 24, 2006, v77i30; Proquest #1085540861, 2pgs.*

* cited by examiner

*Primary Examiner* — Robert M. Pond
(74) *Attorney, Agent, or Firm* — McCormick, Paulding & Huber LLP

(57) ABSTRACT

Methods and systems for providing multiple level text cloud navigation are described, where various categories are displayed in a first text cloud and, when a category is selected, a second text cloud is displayed having child nodes of the selected category and selected lower level nodes. The categories, child nodes, and selected other nodes are displayed using an importance identifier indicative of the number of results in that category or node, a relative importance thereof, a similarities metric, a recommendations metric, or the like.

23 Claims, 19 Drawing Sheets

| |
|---|
| FIG. 2A |
| FIG. 2B |
| FIG. 2C |

METHOD AND SYSTEM FOR PROVIDING MULTI-LEVEL TEXT CLOUD NAVIGATION

BACKGROUND

It is now commonplace for consumers (or customers or shoppers or buyers or users) to select goods or products to be purchased, rented or otherwise obtained from remote client-server based suppliers. Such suppliers may be e-commerce or Internet-based retailers or merchants, which also may be referred to as an on-line retailer or merchant. For example, on-line retailers have set up on-line Internet web sites where consumers can shop for the products (or items or goods) that are available, purchase or rent the products desired, and have the products delivered to them. These products may be tangible goods, such as groceries, books, CDs, DVDs, tools, clothes, footwear, health/beauty items, hardware, office supplies, pet care products, auto care products, industrial supplies or any other tangible goods that are physically delivered to the customer, or "digital" goods, such as electronic books, music, movies/videos, application software, or any other digital product that is downloaded, copied, transmitted or otherwise electronically transferred to the customer. Items could even be animals or people, such as could be used in an animal adoption (or purchase) context or on a social networking or dating website.

It is also known for on-line merchant websites to provide navigation tools that allow the customer to browse and/or search through the merchant website for desired items, information about items, and/or demographic data about purchasing activities of items (e.g., best sellers). Examples of such tools include keyword searches, best seller lists, recommendations lists, new releases, most popular searches, and the like. When using any of these tools, the website may display a list or group of results items based on the product category selected, e.g., books, DVDs, music, etc. When a desired product category is selected, e.g., books, a results list is displayed showing items related to the selected category (books) and a screen menu is displayed (e.g., on the left side of the screen) showing a hierarchical list of the first level of sub-categories available under books, such as fiction, photography, romance, etc. Next, if the customer selects one of these sub-categories, e.g., photography, a results list is displayed showing items related to the selected sub-category (photography) and an updated screen menu is displayed (e.g., on the left side of the screen) showing an updated hierarchical list of the first level of sub-categories available under photography, e.g., wildlife photography, digital photography, etc. This process continues until the customer has narrowed his category selection to the desired category or sub-category. If the customer has "drilled-down" three category levels and then decides to go to a different category or higher level category, the customer must repeat this process again with a newly selected category. Further, when the customer is at a given category level, the customer has no visibility into what other peer categories or sub-categories have results and/or the quantity of those results.

As a result, to find the desired information or item, the customer may spend a significant amount of time sorting through and selecting various lists of categories and sub-categories. Such a review and selection process for browsing a website can be cumbersome, inefficient, and frustrating for the customer and, does not promote customer exploration of the merchant website that could potentially stimulate additional merchant sales.

Accordingly, it would be desirable to have a system or method for providing item information or demographic data to shoppers that overcomes the limitations and inefficiencies of the conventional approaches, that among other potential benefits, provides a more efficient way of searching, browsing, displaying categories and/or selecting categories, makes it more convenient and efficient for the customer to obtain item information and demographic data, and/or encourages customers to search, explore, and discover items or information on the website that they otherwise might not have found, thereby improving the overall shopping experience with the merchant and improving merchant sales.

DETAILED DESCRIPTION

Figure 1:
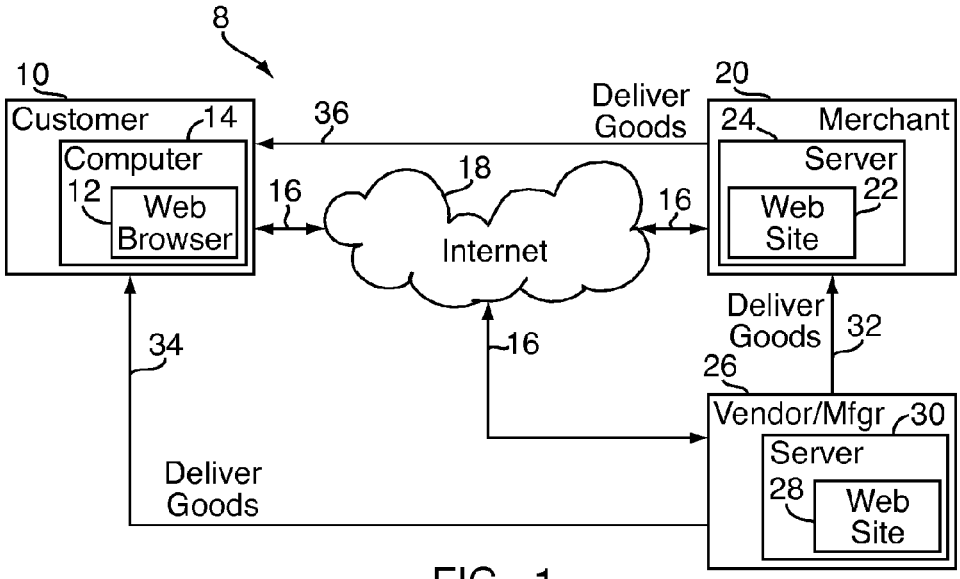
FIG. 1 is a block diagram of the components of a customer-merchant interactive shopping system, in accordance with embodiments of the present disclosure.

As set forth in more detail below, the present disclosure is directed to methods and systems for efficient web site navigation, such as for merchant websites. In particular, the website displays text clouds having various peer level categories and multiple levels of sub-categories (i.e., children, grandchildren, etc.) in a text cloud, thereby allowing the customer to select, view and navigate to various different category levels from a single cloud. In addition, the font size of each category (or sub-category) is indicative of the number of results in that category (or sub-category).

When a given category is selected from the text cloud, the contents of the text cloud is updated to display peers (or siblings) of the selected category (or sub-category) and also to display selected levels of sub-categories (or children, grandchildren, etc.) of the selected category (or sub-category). In addition, the font size of each category (or sub-category) of the updated text cloud is indicative of the number of results in that category (or sub-category). Also, the results associated with the selected category (or sub-category) are displayed under the updated text cloud (e.g., best sellers in New York city).

Also, in certain embodiments, the customer may enter a keyword in a keyword search field and a list of search result categories appear that are related to the keyword entered. When the customer selects the desired results category, a text cloud is displayed as described before, having peers (or siblings) of the selected category (or sub-category) and selected levels of sub-categories (or children, grandchildren, etc.). Also, the results associated with the selected category (or sub-category) are displayed under the updated text cloud.

As used herein, the term "keyword" includes one or more individual words or groupings of alphanumeric characters as well as strings of multiple words or groupings of alphanumeric characters that may include spaces, commas, dashes, slashes, ampersands, asterisks, percents, pound signs, @ signs, parenthesis, plus signs, brackets, underscores, colons, semicolons, question marks, quotations, exclamation points, tildes, apostrophes, quotation marks, or any other delimiter.

Thus, the present disclosure allows the customer, among other things, to efficiently view and navigate to many different areas of the merchant website without having to navigate through numerous screens or menus to obtain the desired information or to identify desired products.

For example, when Mary from Minnesota desires to get information about what unique best sellers are in the books area, she goes to the merchant's unique best sellers (or "purchase circles") page and a text cloud is displayed showing a variety of selectable categories (which are also links), including geographical areas (e.g., United States, Europe, various US states (sub-categories), such as Minnesota, etc., and cities (sub-categories of states), such as Duluth, Minn., etc.), educational institutions (e.g., UCLA, Yale, Duke, etc.), company names (e.g., Microsoft, IBM, Apple, etc.), government agencies and branches (e.g., DOE, NASA, Legislative Branch, etc.), and non-profit organizations (e.g., AMA, AAA, US Red Cross, etc.). The size of the font of each of the categories is indicative of the number of results in that category or sub-category. A results list is displayed under the text cloud and shows a list of unique best sellers in various system-selected categories (as she has not yet made a selection) from the above text cloud. She clicks on the "United States" category link in the text cloud and the contents of the text cloud changes to display category links to all the states in the United States and selected cities and towns. Under the cloud is a list of selected unique best sellers in the United States listing various system-selected cities. She then clicks on the "Duluth" category, and the contents of the text cloud changes to display category links to all cities & towns in Minnesota. Under the text cloud is a list of unique best selling books in Duluth, Minn. She selects a unique best selling book in Duluth about "Fly Fishing" and the book is shipped to her.

FIG. 1 illustrates the various components of an embodiment of an interactive system, such as a customer-merchant client-server based ordering system 8, which includes a customer 10 (or user or consumer or client or shopper or buyer) and an e-commerce or Internet-based merchant (or supplier or retailer or seller or reseller or distributor) 20. The customer 10 can be any entity or individual that wishes to purchase, rent, lease, borrow, or otherwise obtain goods (or products) or services from the merchant 20. The customer 10 uses a client application, such as a web browser 12 running on a computer 14. The merchant 20 is an entity that sells, or otherwise provides items for purchase by customer 10, from a merchant website 22 which is implemented using one or more physical computer servers 24. The customer computer 14 is connected to or communicates with the merchant server 24 through a communications network 18, such as the Internet, as indicated by lines 16, by sending and receiving of digital data over the communications network 18. The customer 10 uses the web browser 12 as a user interface to view and/or communicate with the merchant website 22 that is displayed on the customer computer 14 allowing the customer 10 to interact with the merchant website 22.

In addition, one or more of the goods ordered by the customer 10 may be made by or obtained from one or more third party vendors (or manufacturers) 26. Also, the merchant 20 may be the vendor 26. The vendor 26 is an entity that manufactures goods or has access to goods that the merchant 20 desires to supply to the customer 10 and may sell the goods to the merchant 20 through a vendor website (or other type of order processor) 28, which is implemented using one or more physical computer servers 30. The vendor computer server 30 is connected to or communicates with the merchant server 24 and the customer computer 14, through the communications network 18, as indicated by lines 16. If used by the merchant 20, the vendor 26 may deliver the desired goods to either the merchant 20 or to the customer 10, as indicated by the lines 32,34, respectively. If the goods are delivered to the merchant 20 from the vendor 26, the merchant 20 delivers the goods to the customer, as indicated by a line 32. There may be more than one vendor 26 that supplies goods to the merchant 20 and/or the customer 10.

The computers, servers, and the like described herein have the necessary electronics, software, memory, storage, databases, firmware, logic/state machines, microprocessors, communication links, displays or other visual or audio user interfaces, printing devices, and any other input/output interfaces to perform the functions described herein and/or achieve the results described herein.

Except where otherwise explicitly or implicitly indicated herein, the term "merchant" or "vendor" refers to the associated computer systems operated or controlled by a merchant or vendor, respectively. Thus, process steps described as being performed by the "merchant" or the "vendor", may be automated steps performed by their respective computer systems. These steps are implemented within software modules (or computer programs) executed by one or more general purpose computers. For example, the web browser (or user interface) 12 may be implemented on the computer 14 using one or more software applications. Specially designed hardware could alternatively be used to perform certain operations. Process steps described as being performed by a "customer" are typically performed by a human operator via the computer 14, but could, alternatively, be performed by an automated agent.

The customer 10 may use any web-enabled or Internet applications, such as the web browser 12, or any other client-server applications or features including email, or other messaging techniques to communicate with (or connect to) the merchant web site 22 and/or server 24 through the communications network 18. In addition, the computer 14 may be any of a number of computing devices that are capable of communicating over the network, including but not limited to set-top boxes, personal digital assistants, mobile phones, digital media players, Web pads, tablets, laptop computers, desktop computers, electronic book readers, and the like. The protocols and components for providing communication between the customer computer 14 and the merchant website 22 and/or server 24 are well known to those skilled in the art of computer communications and thus, need not be described in more detail herein.

The data and/or computer executable instructions, programs, firmware, software and the like (also referred to herein as "computer executable components") described herein may be stored on a computer-readable medium that is within or accessible by the customer computer 14 and/or the server 24, having sequences of instructions which, when executed by a processor (or CPU), cause the processor to perform all or a portion of the functions and/or methods described herein. Such computer executable instructions, programs, software and the like may be loaded into the memory of the customer computer 14 or the server 24, using a drive mechanism associated with the computer readable medium, such as a floppy drive, CD-ROM drive, DVD-ROM drive, network interface, or the like.

In order to select one or more items, the customer 10 browses through information concerning goods (or products) or services available for purchase from the merchant 20. After selecting one or more product(s) or service(s) (collectively, "items") that the customer 10 wishes to obtain, an order is sent to the merchant 20. The order is placed via a communication from the web browser 12 to the web site 22 operating on the server 24 of the merchant 20, which includes payment by the customer 10 to the merchant 20 for the items. The merchant 20 then delivers the items to the customer 10 as indicated by the line 36. Alternatively, the vendor 26 may deliver the items directly to the customer 10 as indicated by the line 34.

For purposes of illustration, the systems and methods described herein will be described primarily in the context of a web site that provides functionality for users to browse and make purchases from an electronic catalog; however, as will be recognized, the disclosed systems and methods may also be used in numerous other environments.

Figures 2, 2A:
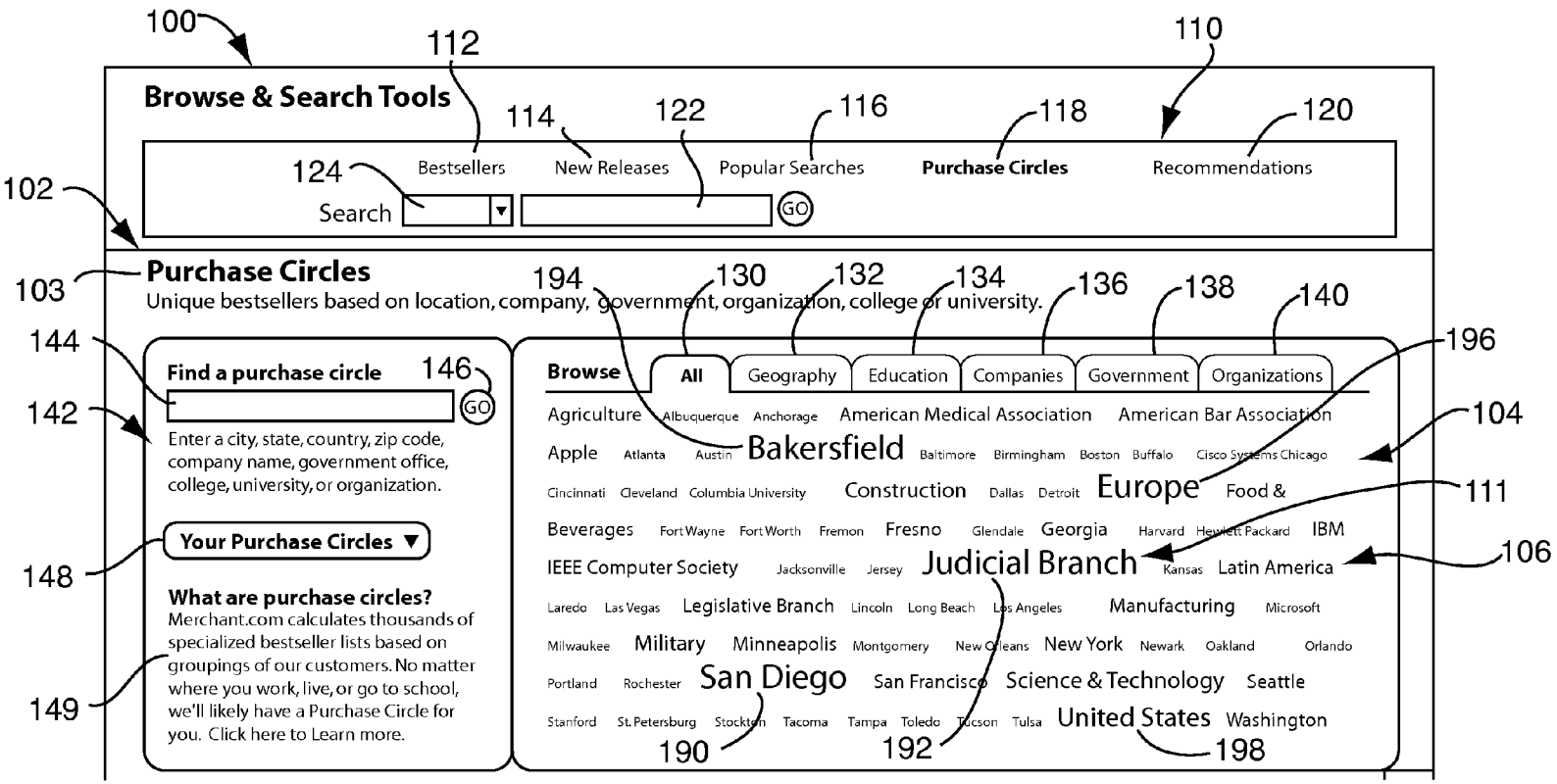
FIG. 2 is a screen illustration of a main screen for a browse tool, having a text cloud and a results list, in accordance with embodiments of the present disclosure.
Figure 2B:
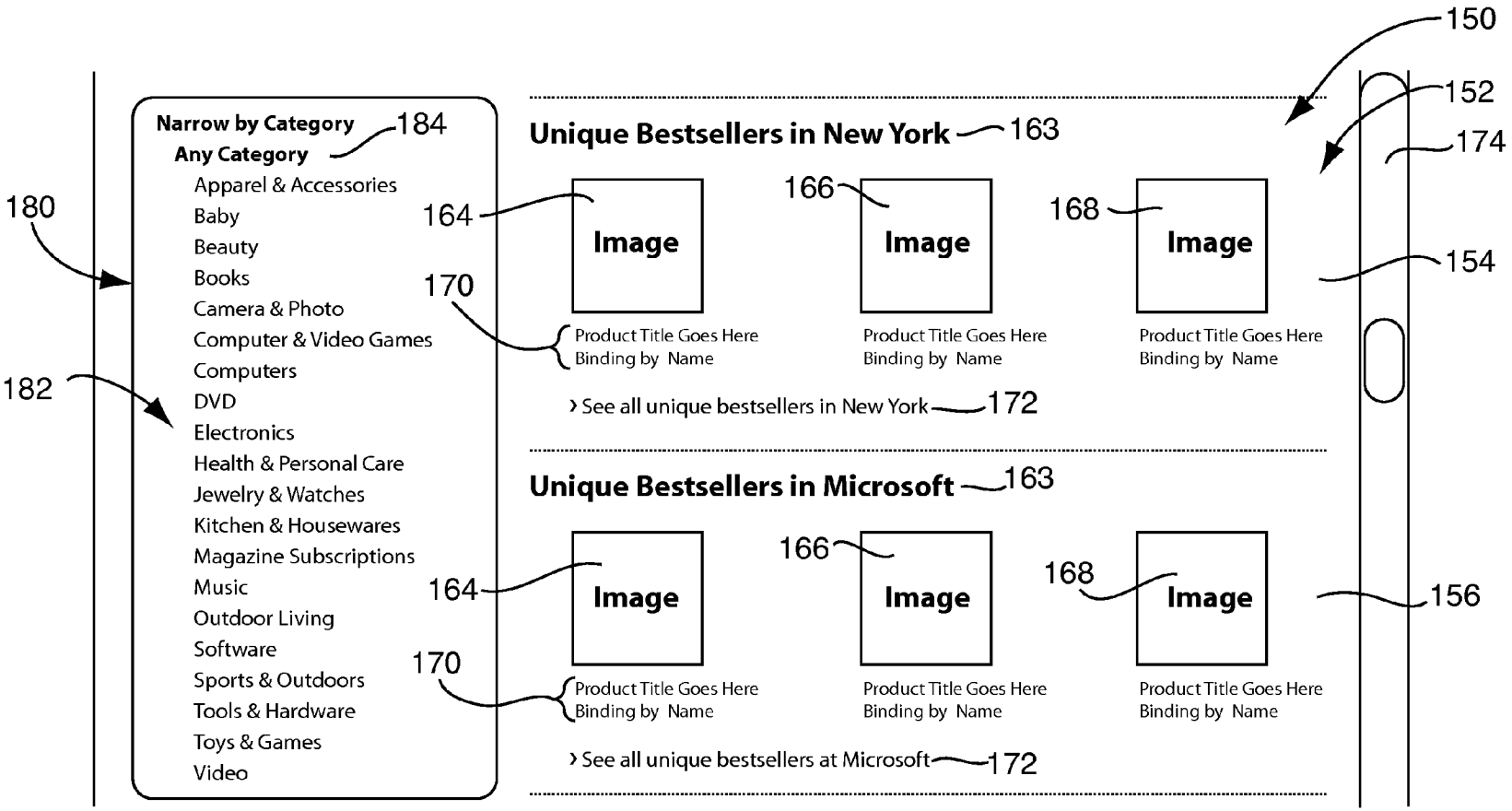
Figure 2C:
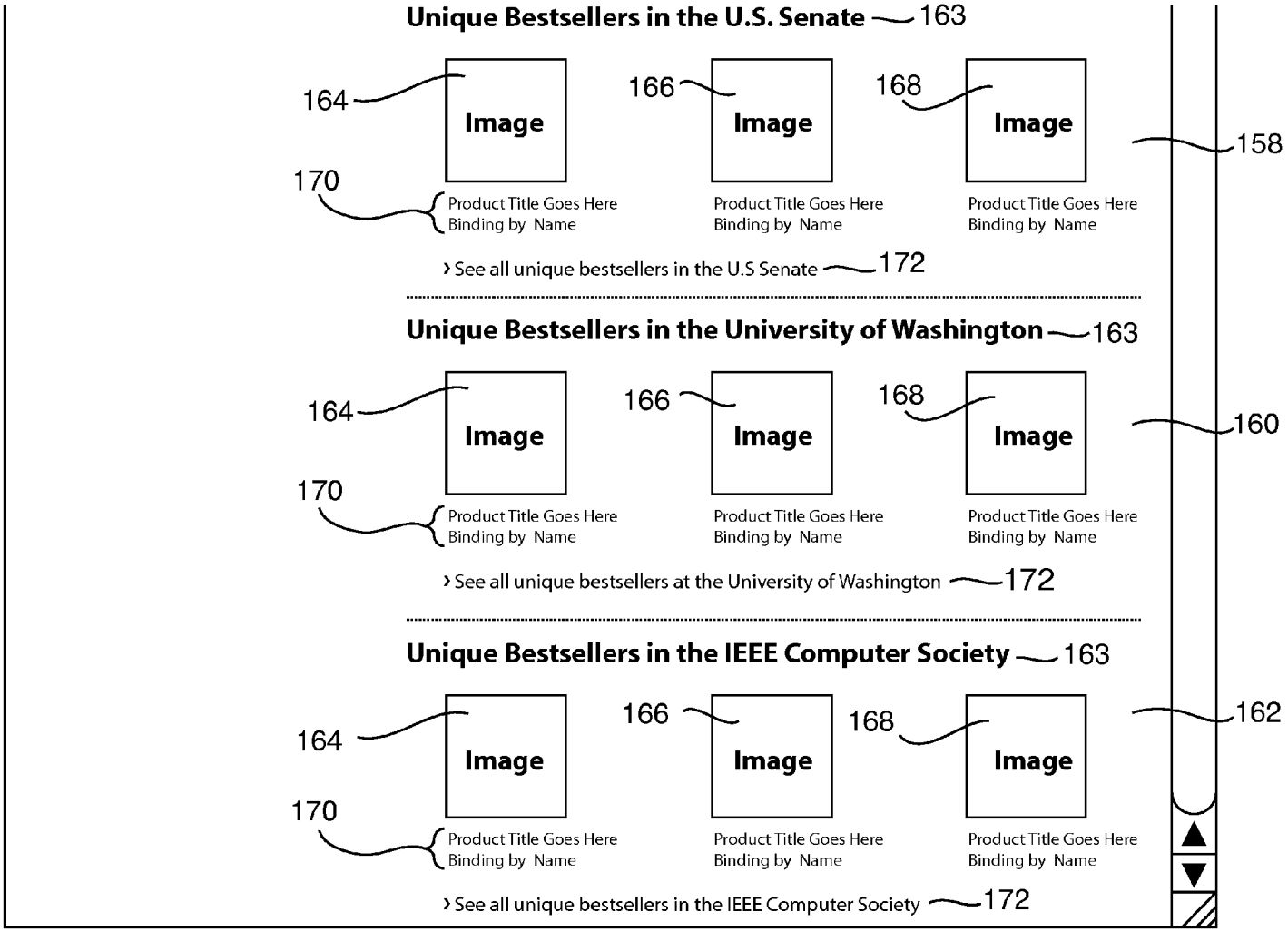

Referring to FIG. 2, a sample merchant website browse and search tools user interface 100 (or graphical user interface (GUI), or window, or screen, or web page, or browser screen) for use by the customer 10 in searching or browsing for items or information from the merchant 20 via the web site 22, includes an optional top screen section 110 having selectable tools 112-120, e.g., bestsellers 112, new releases 114, popular searches 116, purchase circles 118, recommendations 120, etc., where the customer 10 can select the desired tool to browse or search. Any other tools may be used if desired. Also, there is an optional keyword search feature, where the customer 10 can enter a keyword search term in the field 122 and a product category in a field 124 to perform a general website search.

If the customer 10 selects the "purchase circle" link 118, a screen section 102 appears having a title field 103 at the top, entitled "Purchase Circles". Purchase circles is a tool that allows customers to determine what types of items are being purchased uniquely by people associated with certain demographic categories, e.g., people who live or work in a certain geographic location, or people who work for or are associated with a certain company, educational institution, government agency, or organization. To identify such unique results, the purchase circle tool filters out items that are common to the general population, e.g., a nationally popular book, such as Harry Potter. Purchase circles are described in more detail in U.S. Pat. No. 6,963,850, entitled "Community-Based Recommendations", issued Nov. 8, 2005, which is incorporated by reference herein in its entirety. If any of the other tools 112-116,120 are selected, a similar screen section 102 will appear and the field 103 will indicate the corresponding title for the selected tool. In addition, it should be understood that while the sample screens shown herein show results relating to purchase circles, any type of browse or search tools may be used.

Under the Purchase Circle title 103 there is a screen section referred to as a "text cloud" 104. The text cloud 104 displays a list or group of categories (or tags or labels or category names or category tags or category labels) 106 associated with the tool being used, e.g., purchase circles. An example of a text cloud is described in U.S. patent application Ser. No. 11/281,886, entitled "Recommendations Based on Item Tagging Activities on Users", filed Nov. 17, 2005, which is incorporated herein by reference in its entirety. Another example of a text cloud is described in U.S. patent application Ser. No. 11/693,063, entitled "Method and System For Providing Item Recommendations", filed Mar. 29, 2007, which is incorporated herein by reference in its entirety. In the above referenced text cloud patent applications, the text cloud is referred to as a "tag cloud". The names for the categories 106 within the text cloud 104 may be generated manually by the customer (or user) 10 (referred to as "tags"), such as is described in the first aforementioned text cloud patent application, or named by the merchant system, such as is described in the second aforementioned text cloud patent application and as is described hereinafter, or a combination of both, or any other way.

Across the top of the text cloud 104 there may be a series of top level category area tabs 130-140, e.g., All 130, Geography 132, Education 134, Companies 136, Government 138, Organizations 140. Selection of one of the labeled tabs 130-140 (e.g., via a mouse click) will cause the text cloud 104 to display categories associated with the selected top-level category area labeled on that tab. Any tab categories or labels may be used. In the example shown in FIG. 2, which is a default condition before the customer has selected a category tab, the "All" (or "All Categories") tab 130 is selected and, thus, categories from all the top-level categories 132-140 are displayed in the text cloud 104. Other top-level category tabs may be used depending on the tool and application. For example, for the Bestsellers or Recommendations tools, the top-level category tabs 130-140 may be: All, Books, Music, Movies, Electronics, and Camera & Photo, or any other product categories. Alternatively, the category tabs 130-140 need not be used at all and the top-level categories may instead be displayed in the text cloud or not displayed at all.

The text cloud 104 shows category names 106 from all peer-level (or same-level) categories and also from selected multiple levels of sub-categories. For example, if the geography tab 132 is selected, the cloud 104 may show all the top-level countries under geography (i.e., peer-level categories), and also show selected states and cities from each country (i.e., selected multiple levels of sub-categories), discussed more hereinafter. This provides the customer 10 with visibility into multiple browse levels of information on the merchant website in a single screen. Further the category names 106 in the text cloud 104 may be displayed in alphabetical order, quantity order (based on number of results or font size), or any other desired order, and the order displayed may be selectable by the customer 10 by selecting a view button (not shown) in the cloud or elsewhere on the screen 100.

To the left of the text cloud 104, is a keyword search screen section 142 having a keyword search field 144 that allows the customer 10 to enter a keyword search term in the field 144 and select a "GO" button 146 to search for results relating to that keyword (discussed more hereinafter). In addition, there may be a selectable button 148, entitled "Your Purchase Circles", which, when selected, lists the purchase circles for that customer (not shown). Further, the keyword search section 142 may provide a brief description 149 of the selected tool.

Below the cloud 104 is a results screen section 150, which shows a list 152 of the summary results based on the category 106 selected in the text cloud 104. When the customer 10 has not yet selected a category 106 in the cloud 104, a default text cloud 104 may be displayed that has the "All Categories" or "All" tab 130 selected and the results list 152 may be a list of system-selected default results. The default system-selected results may be selected by the merchant system randomly or based on the customer's location, historical purchases, general customer interests, previous high ratings by a customer, most results, most relevant to customer, other personalized customer information, or any other criteria.

In particular, the example in FIG. 2 shows five results summary sections 154-162, e.g., Unique Bestsellers in New York 154, Unique Bestsellers in Microsoft 156, Unique Bestsellers in the US Senate 158, Unique Bestsellers in the University of Washington 160, Unique Bestsellers in the IEEE Computer Society 162, each providing a summary of the results corresponding to a category in the cloud 104, e.g., New York (geography), Microsoft (companies), U.S. Senate (government), University of Washington (education), and IEEE Computer Society (organizations). In each section 154-162, there is a title line 163 corresponding to one of the categories in the cloud 104. Under the title line 163, the top three bestsellers in the particular area are shown by the images 164-168, which are selectable links, which, when selected, brings the customer 10 to a product (or item) detail screen (not shown) for that item. The item detail screen (not shown), as is known, may contain specific detailed information about the item corresponding to the images 164-168, including one or more of: Product Name, Images, Availability, Manufacturer, Price, Shipping information, Product Specifications and/or Features, and the like. The customer 10 may then select the option to purchase the item and the item is shipped to the customer 10. Other numbers of images in the results summary sections 154-162 may be provided if desired.

Under each of the images 164-168 there may be a brief description 170 of the item including the title and author/artist, and/or other desired information about the item. Further, under the brief description, there is a link 172 entitled "See all unique bestsellers in New York" (for section 154), which, when selected, brings the customer 10 to a screen (discussed hereinafter) that lists all unique best sellers purchased by people (or organizations) associated with the geographical area of New York City. If there are be more results provided than will fit on one screen, a scroll bar 174 may be provided to scroll through the other results.

To the left of the results section 150 there may be a product category filter screen section 180, entitled "Narrow by Category", which shows a product category filter list 182 of all product categories. If the customer 10 selects any of the product categories 182, the results displayed in the results section 150 are filtered and updated to display only those results relating to the selected product category. The system defaults to the Any Category option 184 when the results are first displayed in the results section 150.

According to some embodiments, each of the categories 106 in the text cloud 104, may be displayed having a predetermined quantity identifier 111, e.g., font size, indicative of the number (or quantity) of results or the number (or quantity) of purchasers, collectively, the "number of results", associated with that category. The larger the text font size, the larger the number of results associated with that text category. Accordingly, for the example shown in FIG. 2, the categories 190 (San Diego), 192 (Judicial Branch), 194 (Bakersfield), and 196 (Europe), in the text cloud 104 have a larger number of results than the rest of the categories 106 in the cloud 104 because they have the largest font sizes in the text cloud 104. The relationship between the font size and the number of results associated with that category may be as shown in Table 1 below, where a predetermined range of results for a given category corresponds to a certain category text font size. Any other ranges or font sizes may be used if desired. Optionally, if there are less than a predetermined minimum number of results for a given category, e.g. two, the category name is not displayed in the text cloud 104. Other or no minimum number of results for display of the categories in the cloud 104 may be used. Also, different minimum numbers may be used for different tools or categories.

TABLE 1

| Number of Results | Category Text Font Size |
|---|---|
| 0 to 2 | Not Displayed |
| 3 to 5 | 9 pt. |
| 6 to 10 | 10 pt. |
| 11 to 15 | 12 pt. |
| 16 to 20 | 14 pt. |

The quantity identifier may be a characteristic, attribute, or visual effect of the text of the category, e.g., font size, font style, font color, etc., or it may be another visual effect or attribute associated with the category, e.g., background color, outline color, images, etc., or any combination of the above, or any other quantity identifier that allows the customer 10 to determine the relative number of results in each category by looking at the window 104. The quantity identifier associated with each category may also use compound visual effects, such as displaying a combination of various text fonts, colors, and/or images with an adjacent number indicative of the number of results for that category in the cloud 104, e.g., subscript, superscript, parenthetical, or the like. Also, for any of the embodiments described herein, the number of results may appear in a pop-over window (not shown) upon a mouse-over of a category in the cloud 104. For example, when the customer 10 mouses over the "United States" category 198 in FIG. 2, a pop-over window (not shown) may appear with a message indicating the number of results for the category 198, e.g., "Number of Results=5,430".

According to some embodiments, the visual effect of the displayed categories in the text cloud 104 could represent features other than the quantity of results in that category. For example, among others, the visual effect could represent the significance or importance of the results in a particular category, could represent categories having items believed to be a favorite of the customer 10, could represent categories having items or results with the most similar items (i.e., the highest similarities score or metric), or could represent categories having items or results with the most recommendations (e.g., the highest recommendations score or metric), or any other characteristic or attribute of the items or results in a given category. For example, if there are results in a particular category that are believed to be more significant or important to the customer 10 than results in other categories, (even though other categories may have the same or greater number of results) this could be reflected by, among other visual effects, providing contrasting font sizes or styles that are readily recognized by the user. In addition, there may be a selectable button (not shown) on the screen which allows the customer 10 to select the type of identifier or visual effect.

Each identifier or visual effect described herein is collectively referred to herein as an "importance identifier".

Furthermore, in some embodiments, the categories in the text cloud 104 may be images, icons, videos, video clips, or other visual representations of the categories. For example, a sporting goods category could be represented by an icon depicting a tennis racket, a romance category could be represented by a heart, a geography category could be represented by an icon depicting a globe, a country category could be represented by an icon depicting a flag, and a university, company, or organization category could be represented by an icon depicting its trademark or other recognized symbol. In such embodiments, the visual effect of the importance identifier may include using contrasting sizes or colors of the visual representation, among other possibilities. Further, the categories may be a combination of system-generated and/or user-generated category names.

The location of the text cloud 104, the results list 150, the keyword search section 142, and the product category filter list ("Narrow by Category") section 180, may be located in any location on the screen 100. For example, results list top and text cloud bottom; results list bottom and cloud top; results list left and cloud right; and results list right and cloud left. Further, for example, the text cloud 104 may list the categories 106 vertically, horizontally, or at any other angle. Still further, the shape of the text cloud 104 may be any desired shape.

Figures 3, 3A, 3B, 3C:
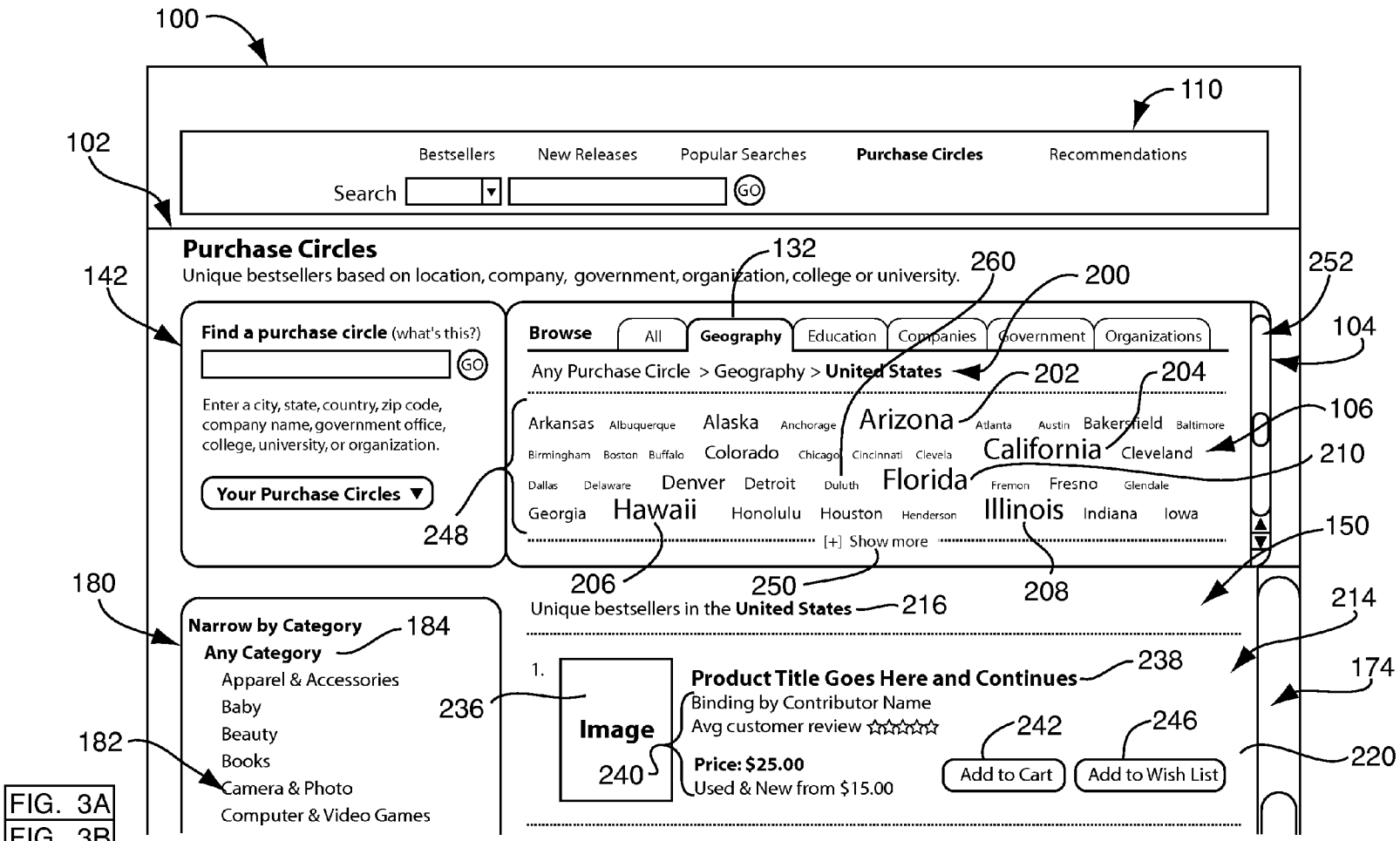
FIG. 3 is a screen illustration of the screen in FIG. 2 with an updated text cloud and results list based on the selection of a category in the text cloud of FIG. 2, in accordance with embodiments of the present disclosure.
Figure 3B:
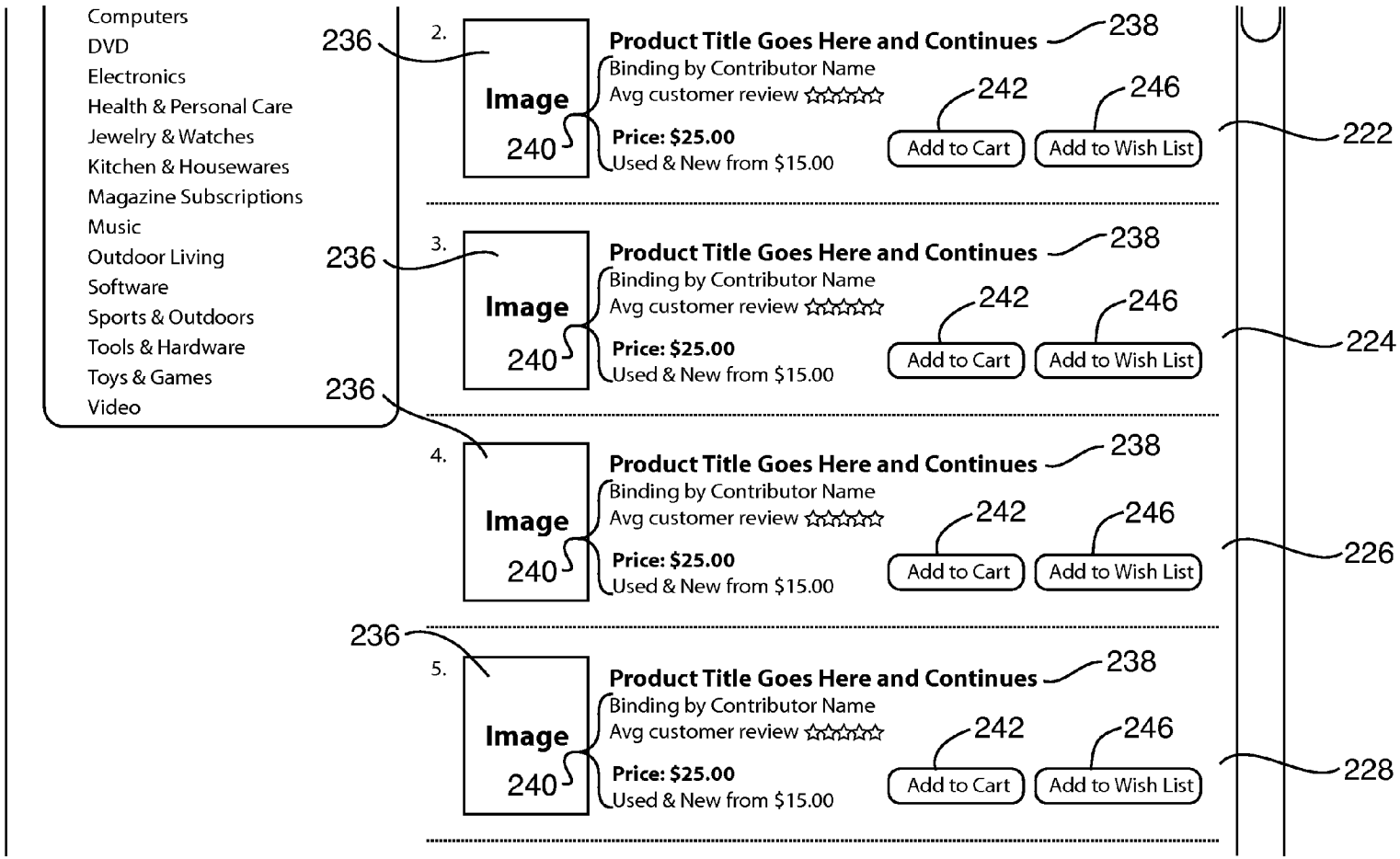
Figure 3C:
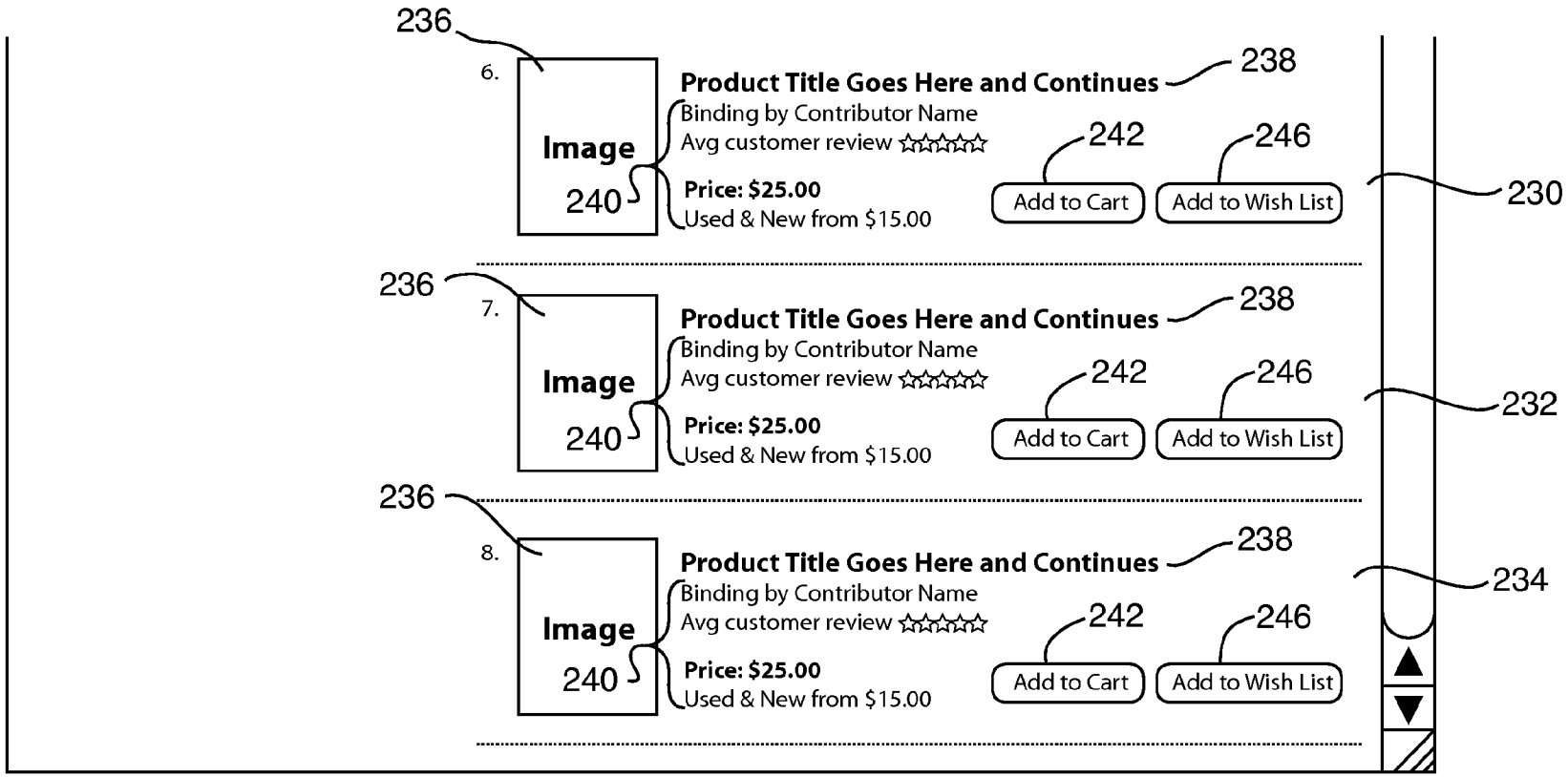

Referring to FIG. 3, if the customer 10 selects the "United States" category 198 in the text cloud 104 of FIG. 2, the text cloud 104 updates to show the geography tag 132 as selected, because United States is under the geography category. Also, a browse chain 200 is displayed which shows the current position in the browse hierarchy, e.g., "Any Purchase Circle>Geography>United States" (discussed more hereinafter). In addition, the text categories 106 displayed in the cloud 104 are updated to show all the states in the United States. Similar to that described above for FIG. 2, the states Arizona 202, California 204, Hawaii 206, Illinois 208, and Florida 210 have the largest fonts and, thus, the largest numbers of results.

Below the updated text cloud 104 in the results section 150, is a list 214 of results 220-234 based on the selected category 198 (e.g., United States), which lists unique best sellers in the United States, as indicated by the title line 216. In particular, eight results 220-234 are listed, each being an item which was purchased by a people or entities in the United States. The list is sorted by "sales rank", e.g., items with the most number of sales to the least number of sales. Each result item has an image or icon 236 which is a selectable link, which, when selected, brings the customer 10 to a product detail screen (not shown) for that item. To the right of the image 236, there is a title 238 of the item which is also a selectable link, which, when selected, brings the customer 10 to a product detail screen (not shown) for that item. Under the title 238 there is a brief description 240 of the item including the author/artist and/or other desired information about the item.

To the right of the description 240 is a selectable button 242, "Add to Cart" which, when selected, adds the item to the shopping cart for the customer 10. To the right of the button 242 is a button 246 which, when selected, adds the item to a wish list of the customer. If there are more results on the list 150 than will fit on one screen, the scroll bar 174 may be provided to scroll through the other results.

As discussed hereinbefore, the product category filter list ("Narrow by Category") section 180, which shows the list 182 of all product categories, defaults to the Any Category 184 option when the results are first displayed in the results section 150. If the customer 10 selects any of the specific product categories 182, the results displayed in the results section 150 is updated to display only those results relating to the selected product category.

Figures 4, 4A, 4B:
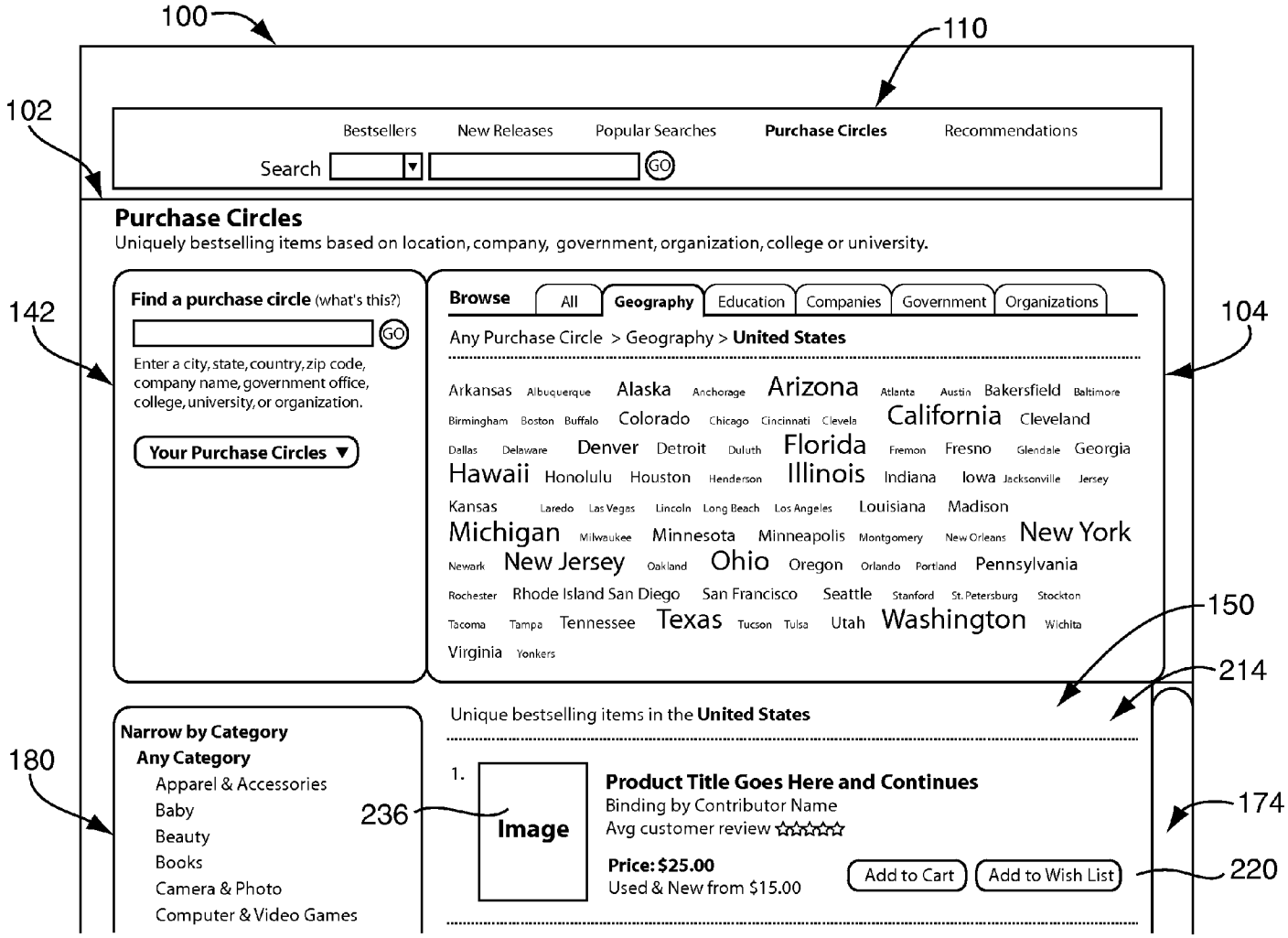
FIG. 4 is a screen illustration of the text cloud of FIG. 3 having an expanded size showing all links in the cloud, in accordance with embodiments of the present disclosure.
Figure 4B:
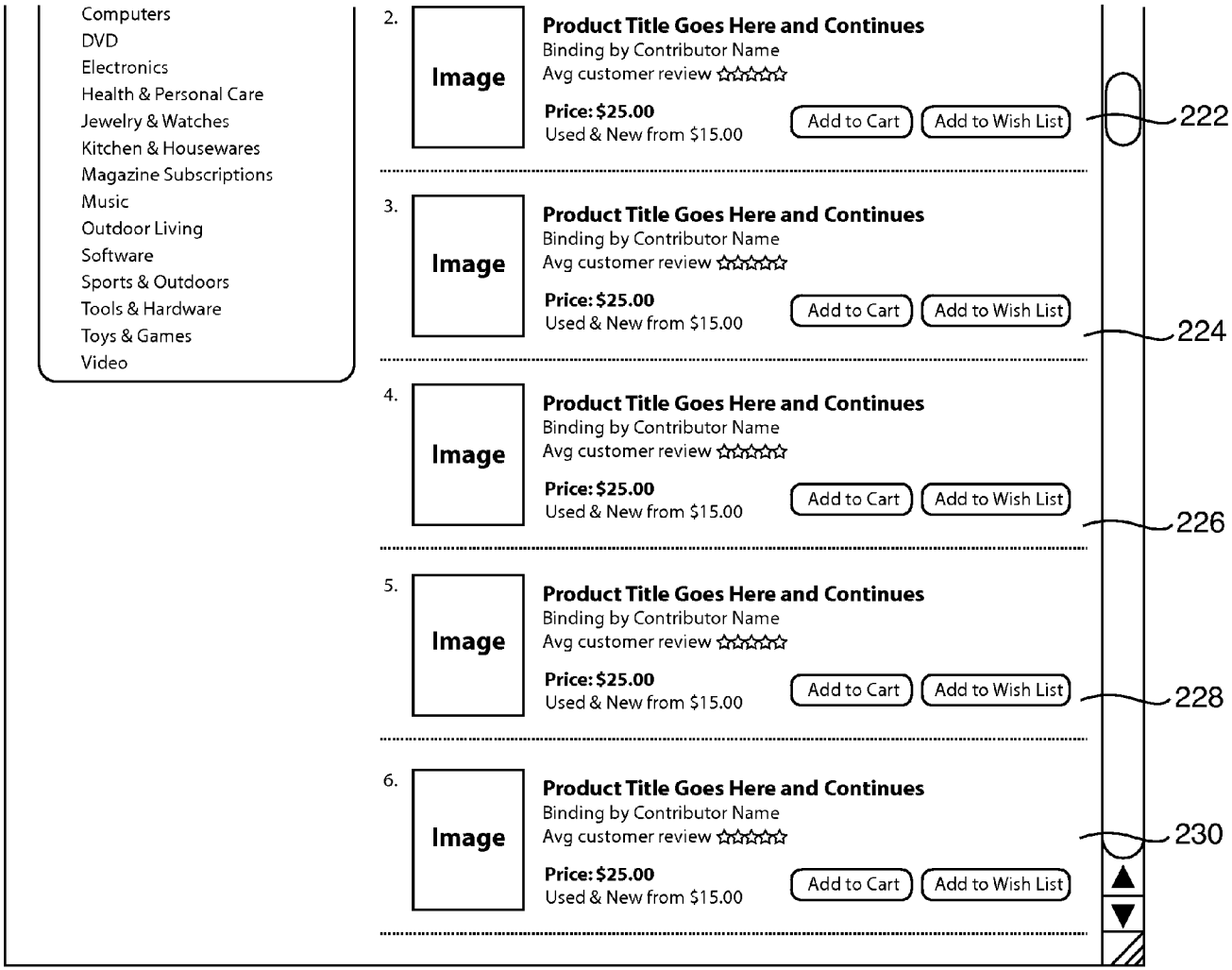

Referring to FIGS. 3 and 4, the text cloud 104 in FIG. 3 shows a default number of rows 248, e.g., four rows of categories. If the number of categories cannot be displayed within these rows, a selectable link 250 "[+] Show More" is provided, which when selected, expands the size of the cloud 104 to that shown in the text cloud 104 of FIG. 4. In that case, the number of results items in the results list 214 is reduced to a smaller number of items 220-230 that will fit onto the screen, as shown in FIG. 4. Optionally, a cloud scroll bar 252 (FIG. 3) may be provided in the text cloud 104, which allows the customer 10 to scroll through the rows of categories in the text cloud 104.

Figures 5, 5A, 5B, 5C:
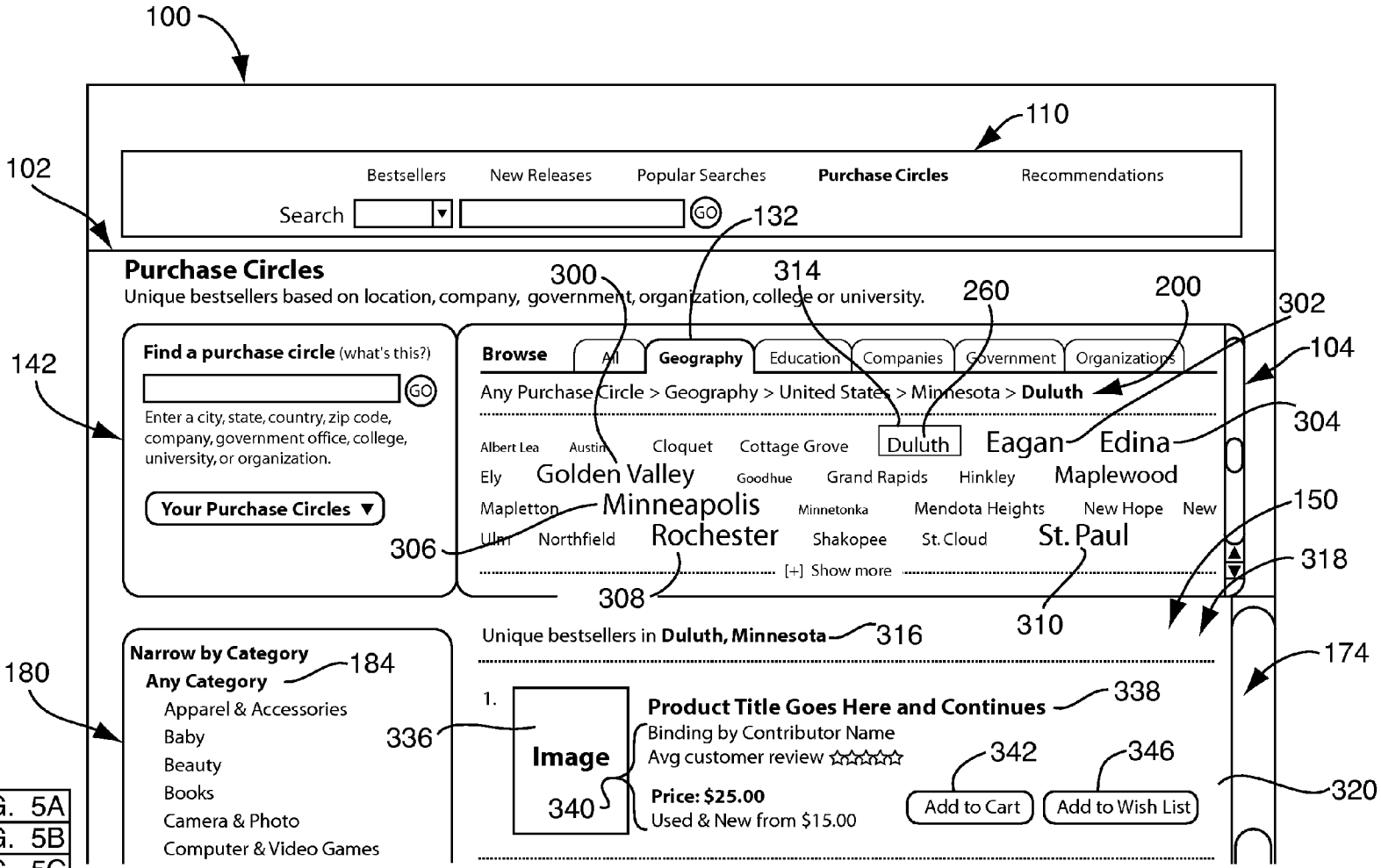
FIG. 5 is a screen illustration of the screen of FIG. 3, with an updated text cloud and results list based on the selection of a category in the text cloud of FIG. 3, in accordance with embodiments of the present disclosure.
Figure 5B:
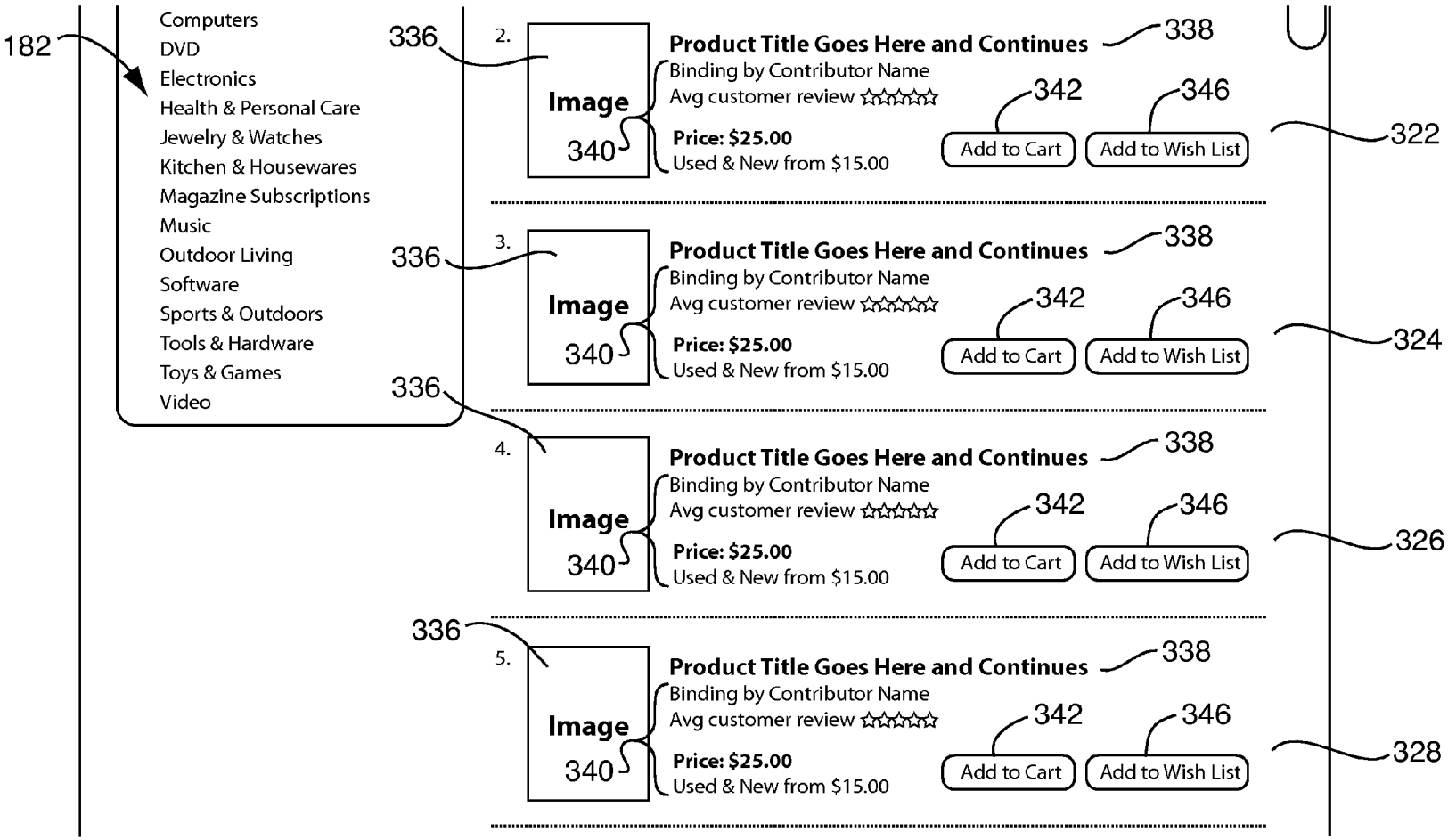
Figure 5C:
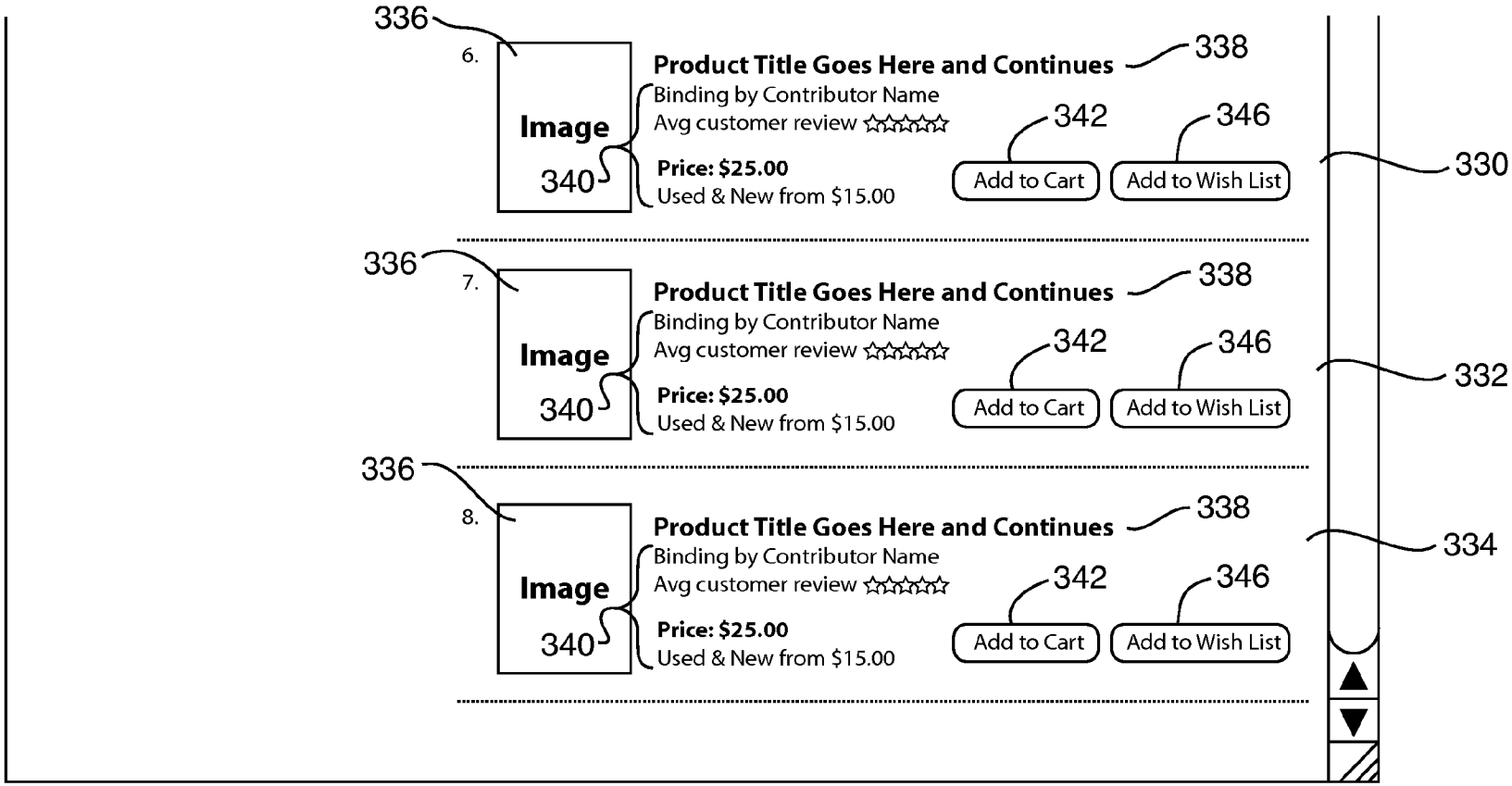

Referring to FIG. 5, if the customer 10 selects the "Duluth" category 260 in the text cloud 104 of states in FIG. 3, the text categories 106 displayed in the cloud 104 are updated to show all the cities in Minnesota, i.e., peer categories to the Duluth city category, as there are no lower-level categories below the city level to be displayed and also shows a box 314 around Duluth 260. Instead of or in addition to the box 314, an outline, a color, shading, shadow, or any type of highlighting, mark, or indicia may be displayed so that the selected status of the category is distinguishable from those categories that have not been selected.

Also, the browse chain 200 is updated to show the current position of this category selection in the browse hierarchy, e.g., "Any Purchase Circle>Geography>United States>Minnesota>Duluth" (discussed more hereinafter). Further, the geography tab 132 as still selected, because Duluth is a sub-category city under Minnesota, which is a sub-category state under the United States, which is a sub-category under the main Geography category. Similar to that described above for FIGS. 2 and 3, the cities Golden Valley 300, Eagan 302, Edina 304, Minneapolis 306, Rochester 308, and St. Paul 310 have the largest fonts and, thus, the largest numbers of results, as discussed herein before.

Below the updated text cloud 104 in the results section 150, is a list 318 of results 320-334 based on the selected category 260 (e.g., Duluth), which lists unique best sellers in Duluth, Minn., as indicated by the title line 316. In particular, the eight results 320-334 are listed, each being an item that was purchased by a people or entities in the Duluth, Minn. The list is sorted by "sales rank", e.g., items with the most number of sales to the least number of sales. Each result item has an image or icon 336 which is a selectable link, which, when selected, brings the customer 10 to a product detail screen (not shown) for that item. To the right of the image 336, there is a title 338 of the item which is also a selectable link, which, when selected, brings the customer 10 to a product detail screen (not shown) for that item. Under the title 338 there is a brief description 340 of the item including the author/artist and/or other desired information about the item.

To the right of the description 340 is a selectable button 342, "Add to Cart" which, when selected, adds the item to the shopping cart for the customer 10. To the right of the button 342 is a button 346 which, when selected, adds the item to a wish list of the customer. If there are more results on the list 150 than will fit on one screen, the scroll bar 174 may be provided to scroll through the other results.

As discussed hereinbefore, the product category filter list ("Narrow by Category") section 180, which shows the list 182 of all product categories, defaults to the Any Category 184 option when the results are first displayed in the results section 150. If the customer 10 selects any of the specific product categories 182, the results displayed in the results section 150 is updated to display only those results relating to the selected product category.

Figure 6:
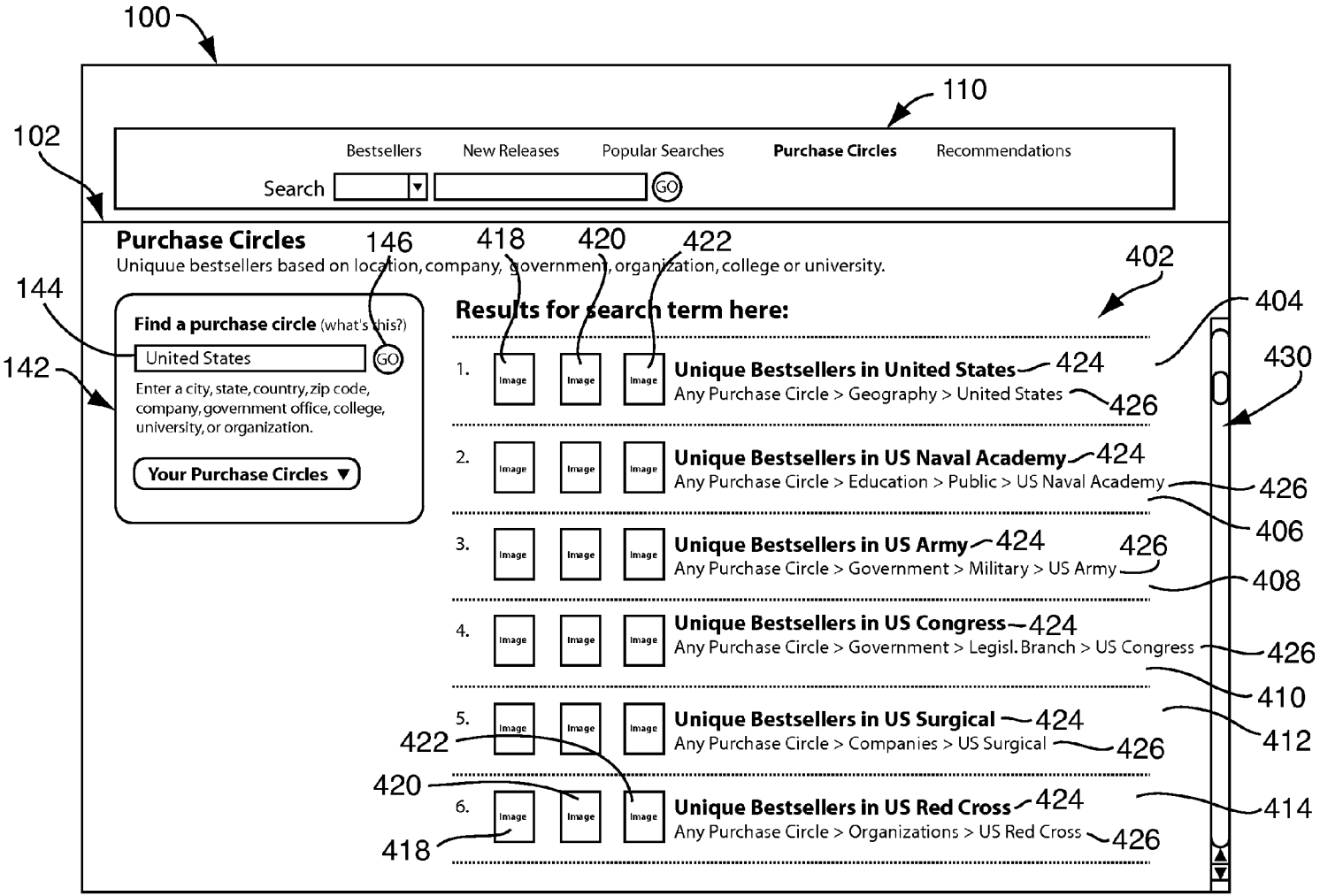
FIG. 6 is a screen illustration of a search results list for the keyword search term "United States", in accordance with embodiments of the present disclosure.

Referring to FIGS. 2 and 6, if the customer 10 enters a keyword search term, e.g., "United States" in the field 144, and clicks on the GO button 146, the system performs a search of all purchase circles in all categories and identifies the purchase circles that have the keyword search term in the purchase circle title. The screen 100 is then updated to display a summary results list 402 in the location of the text cloud 104 of FIG. 2. Optionally, the text cloud 104 may remain displayed on the screen 100 and the summary search results list 402 displayed below the cloud 104. Further, in that case, the text cloud 104 may display only the categories for which the search results found matches, thereby also filtering the contents of the text cloud 104.

The example in FIG. 6 shows six results summary sections 404-414, e.g., Unique Bestsellers in United States 404, Unique Bestsellers in US Naval Academy 406, Unique Bestsellers in the US Army 408, Unique Bestsellers in the US Congress 410, Unique Bestsellers in the US Surgical 412, Unique Bestsellers in the US Red Cross 414, each providing a summary of the search results corresponding to a purchase circle under a category in the cloud 104, e.g., United States (geography), US Naval Academy (education), U.S. Congress (government), US Surgical (company), and US Red Cross (organizations). In each section 404-414, there is a title line 424 corresponding to one of the purchase circles in one of the categories in the cloud 104. To the left of the title line 424, the top three bestsellers in the particular area are shown by the images 418-422, which are selectable links, which, when selected, brings the customer 10 to a product detail screen (not shown) for that item. Other numbers of images in the results summary sections 404-414 may be provided if desired. Under the title line 424 is a browse chain 426, which indicates the browse path used to obtain the specific result displayed.

Under each of the images 418-422 there may be a brief description (not shown) of the item including the title and author/artist, and/or other desired information about the item (similar to that shown in FIG. 2). Further, under the brief description, there may be a link (similar to that shown in FIG. 2, not shown in FIG. 6) to "See all unique bestsellers in United States", which, when selected, brings the customer 10 to the screen 100 discussed hereinbefore with FIG. 3 that lists all unique best sellers purchased by people (or entities) associated with the geographical area of the United States. If there are more results provided than will fit on one screen, a scroll bar 430 may be provided to scroll through the other results.

Figure 7:
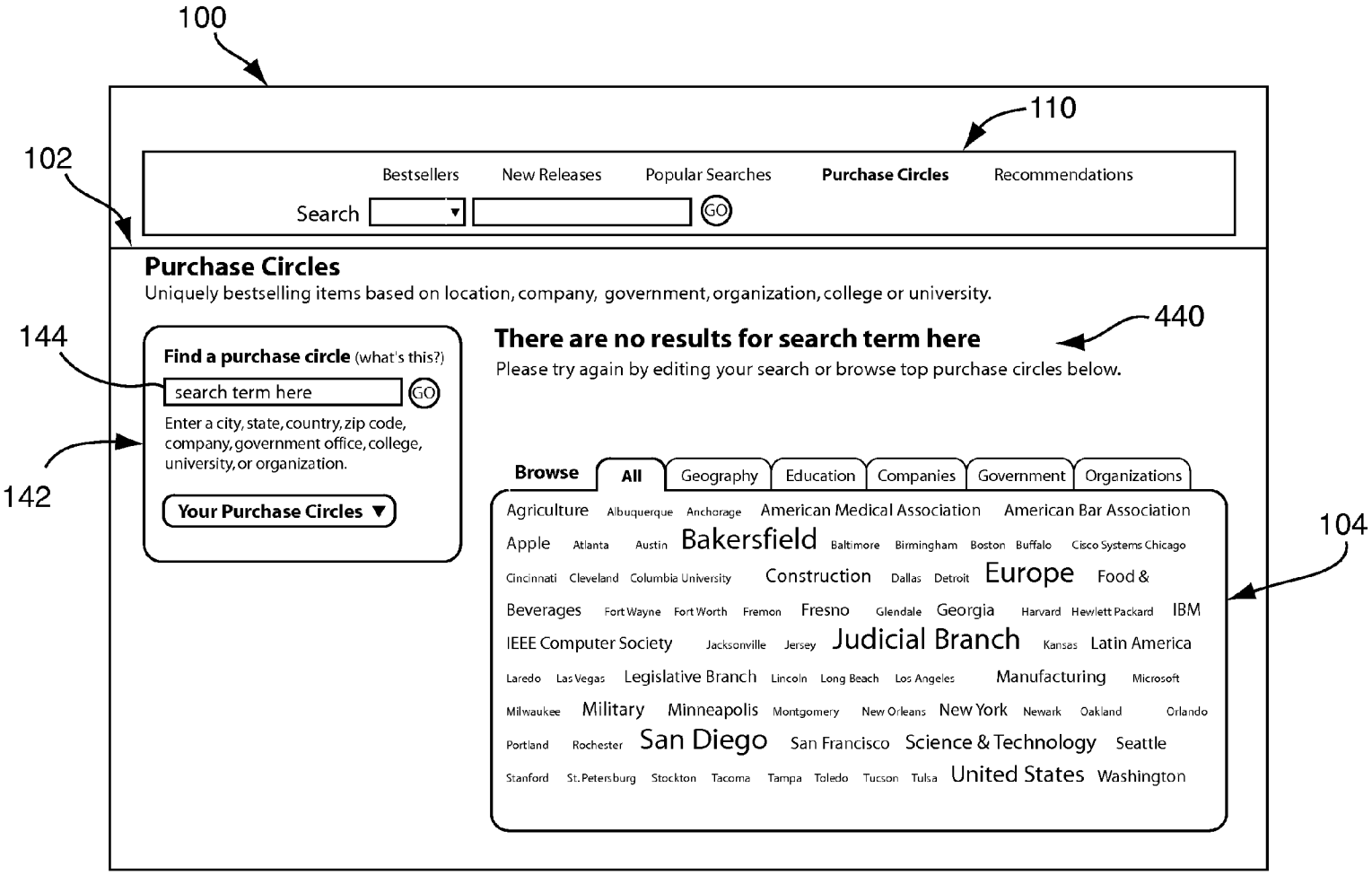
FIG. 7 is a screen illustration of search results where there were no search results for the keyword search term entered, in accordance with embodiments of the present disclosure.

Referring to FIG. 7, if there are no results for the search term entered in the search field 144, a message 440 is displayed on the screen 100, stating: "There are no results for search term here. Please try again by editing your search or browse top purchase circles below". Under the message 440 the top level text cloud 104 is displayed to allow the customer to select a category if desired.

Figure 8:
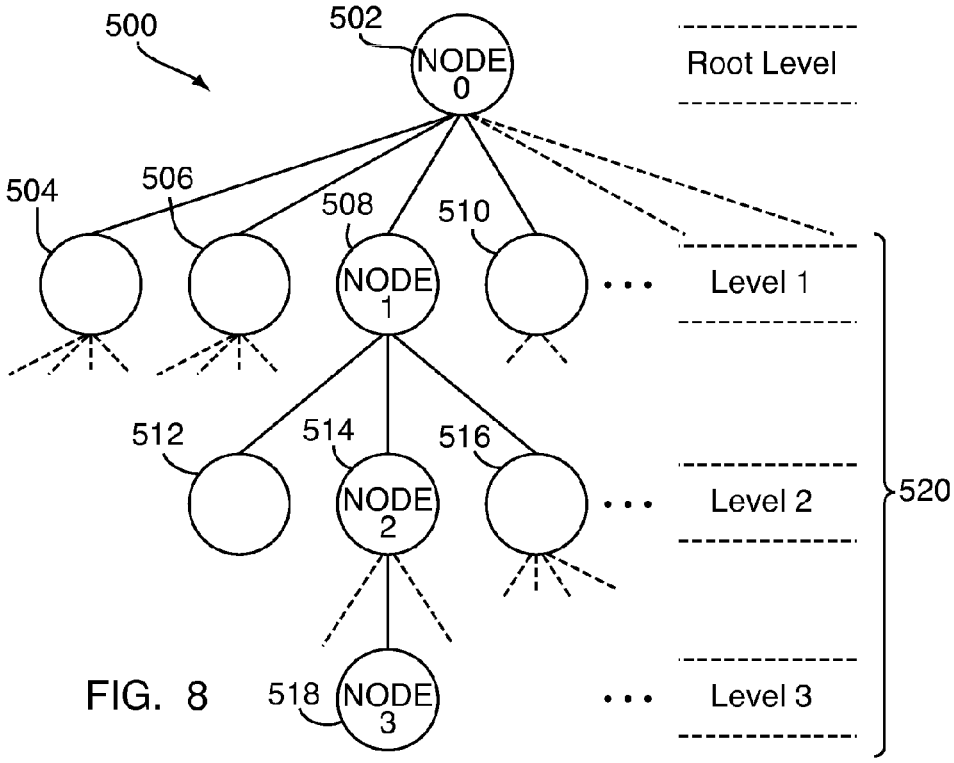
FIG. 8 is a diagram of a generic browse node tree, in accordance with embodiments of the present disclosure.

Referring to FIG. 8, it is known in the art of computer databases and computer-based websites to use "browse trees" to help categorize and/or identify items, such as is described in pending U.S. patent application Ser. No. 11/540,933, filed Sep. 29, 2006, entitled "Method And System For Displaying Attributes Of Items Organized In A Searchable Hierarchical Structure", which is incorporated herein by reference in its entirety. As the name suggests, a "browse" tree 500 permits users (or the merchant) to "browse" through various items, which are logically arranged in the form of a hierarchical tree arrangement of browse nodes 502-518, having a plurality of different levels 520. Each of the browse nodes 502-518 may be associated with a category of items in a hierarchical manner. Thus, the browse tree 500 may be viewed as a collection of categories, each category corresponding to one of the browse nodes 502-518 of the tree 500 and each of the browse nodes 502-518 being associated with one or more items. The merchant server 24 may store the information and relationships associated with one or more browse trees for all items sold by the merchant. Accordingly, the browse tree 500 may be used by the merchant website 22 to display categories or groups of items or information about items for the customer 10 to use while shopping or browsing the merchant website 22 as well as used to categorize and/or identify items or information about items for various uses.

More specifically, in FIG. 8, a "root" level node (or root node) 502 of the tree 500 may represent all or a subset of items in a given category of items on the merchant 20 website 22, such as "Books," "DVDs", "Electronics," "Tools and Automotive," etc. Each root browse node 502 may have different child browse nodes 504-510 representing sub-categories under the parent or root node 502. Similarly, each of the child nodes 504-510 may have different lower level child nodes, e.g., for node 508, there may be three child nodes 512-516. Also, under each of the nodes 512-516 there may be one or more lower level child nodes, such as the child node 518 under the parent node 514. In this example, the node 518 is also at the bottom of the tree 500 and is referred to as a "leaf" node. A leaf node has associated with it one or more specific items or specific information about items, e.g., best sellers, new releases, popular searches, purchase circles, recommendations (i.e., "leaves"), which are all related to the leaf node 518. Also, a leaf node may be at any level in the tree and has no child nodes. Accordingly, due the hierarchical structure of the tree 500, a given item or result may be associated with a plurality of nodes at different levels in the same node lineage (or tree branch). For example, in FIG. 8, all the items or results associated with the level 3 node 518 are also associated with the higher level parent nodes 514 (level 2 node), 508 (level 1 node), and 502 (root node or level 0 node). Further, the number of items or results associated with a given node decreases with lower browse node levels along a given branch.

Figure 9:
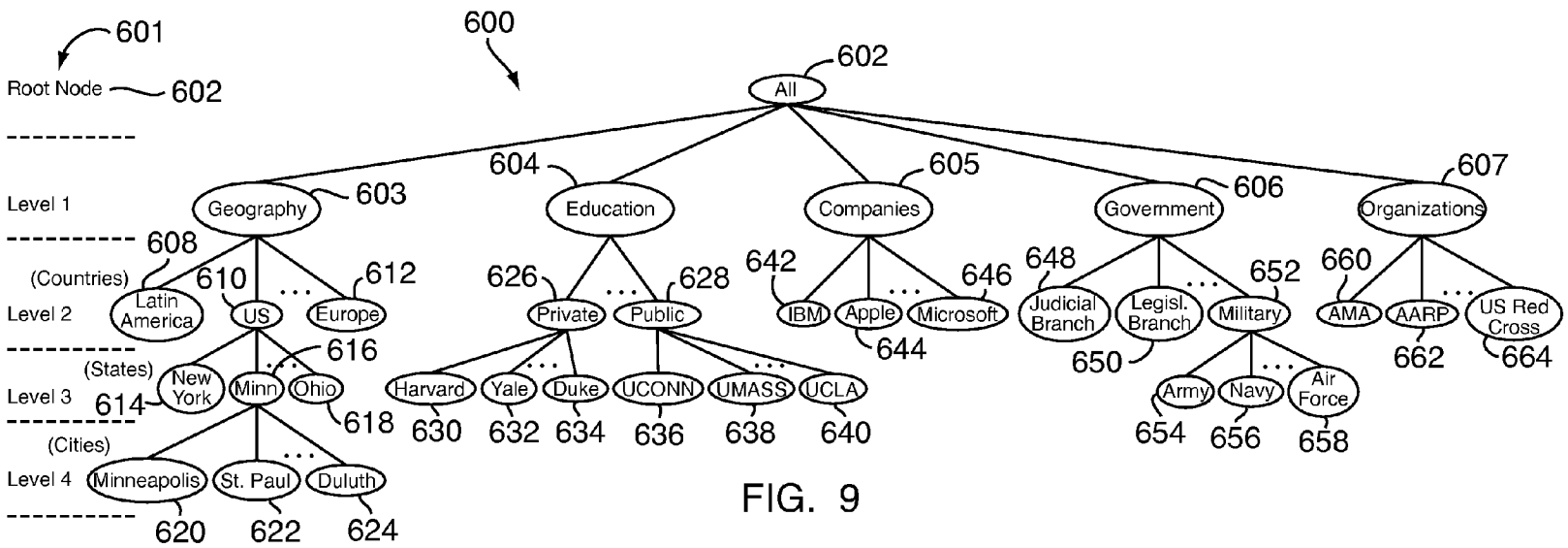
FIG. 9 is a diagram of an example browse node tree, in accordance with embodiments of the present disclosure.

Referring to FIG. 9, a sample tree 600 is illustrated that shows four levels 601 below a root level node 602 for a main category of "ALL", and five main (top-level) branches 603-607 of browse nodes corresponding to "Geography", "Education", "Companies", "Government", and "Organizations", respectively, all at the same node level 1. The "Geography" branch 603 has three child nodes 608-612. The "US" node 610 has three child nodes 614-618 at level 3, and the "Minnesota" node 616 has three child nodes 620-624 at level 4. The "Education" branch 604 has two child nodes 626,628 at level 2. The "Private" node 626 has three child nodes 630-634 at level 3 and the "Public" node 628 has three child nodes 636-64 at level 3. The "Companies" branch 605 has three child nodes 642-646 at level 2. The "Government" branch 606 has three child nodes 648-652 at level 2 and the "Military" node 652 has three child nodes 654-658 at level 3. Finally, the "Organizations" branch 607 has three child nodes 660-664 at level 2.

When a text cloud category 106 is selected, the new text cloud displays all (or substantially all) first level child nodes for a selected category (depending on the number of results and whether any thresholds are set—see discussion with Table 1), and also displays selected lower level child nodes (or sub-categories). The selected lower level child nodes are selected based on nodes that may be useful to the customer, such as nodes that have a large number of results, have a personal connection to the customer, e.g., due to customer location, previous customer purchases, general customer interests, previous high ratings by a customer, most relevant to customer, other personalized customer information, or any other criteria. Thus, the categories displayed may skip one or more node levels in the selection of useful lower level child nodes. In addition, some selected child nodes may be randomly selected to allow the customer to see other parts of the merchant website that he/she might not normally have seen. In addition, if the category selected has no child nodes (i.e., a leaf node was selected), then the system shows all peer nodes at same level as the selected category.

Figures 13, 13A, 13B:
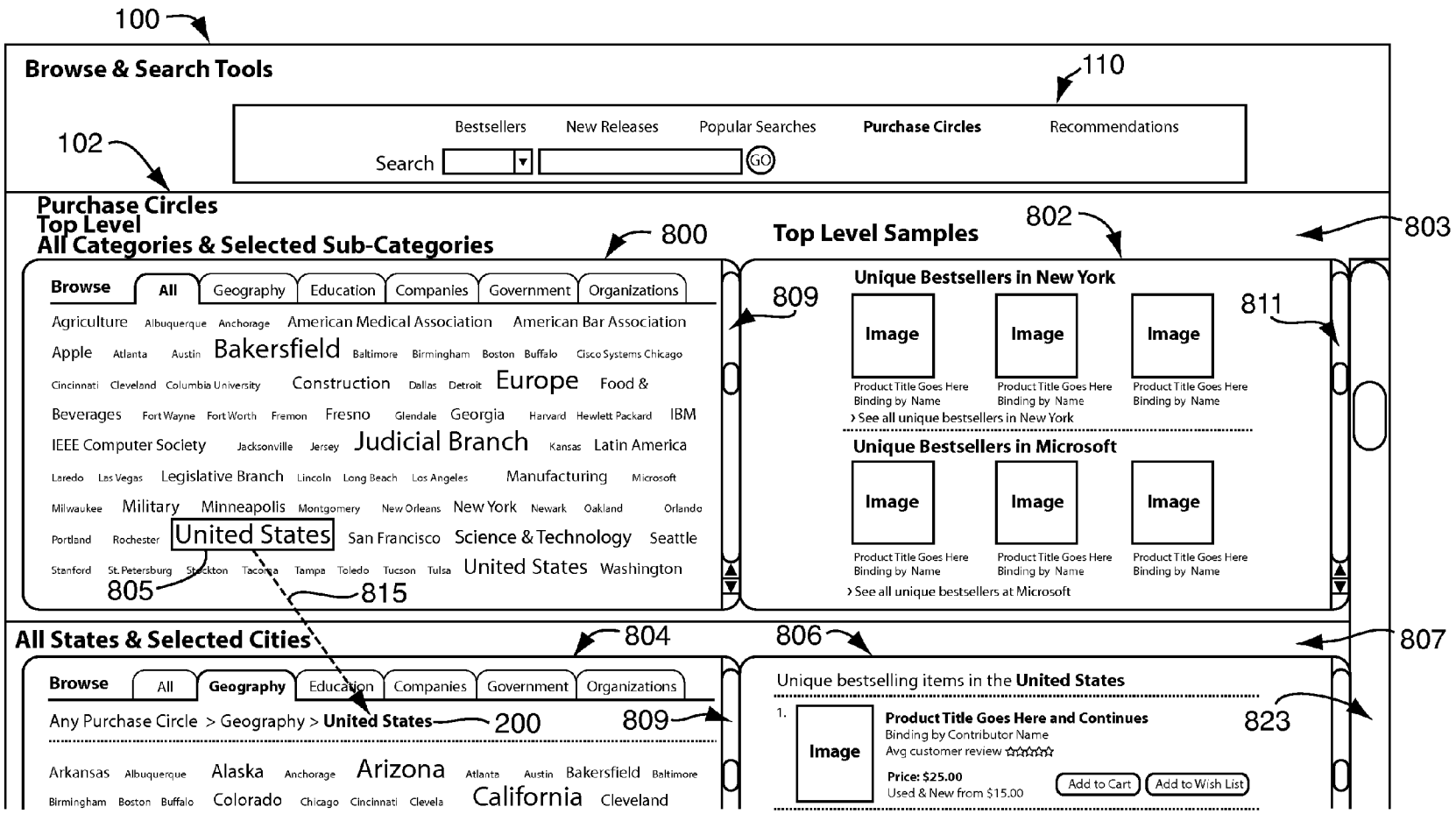
FIG. 13 is a screen illustration of a main screen for a browse tool, having multiple text clouds and results lists, in accordance with embodiments of the present disclosure.
Figure 13B:
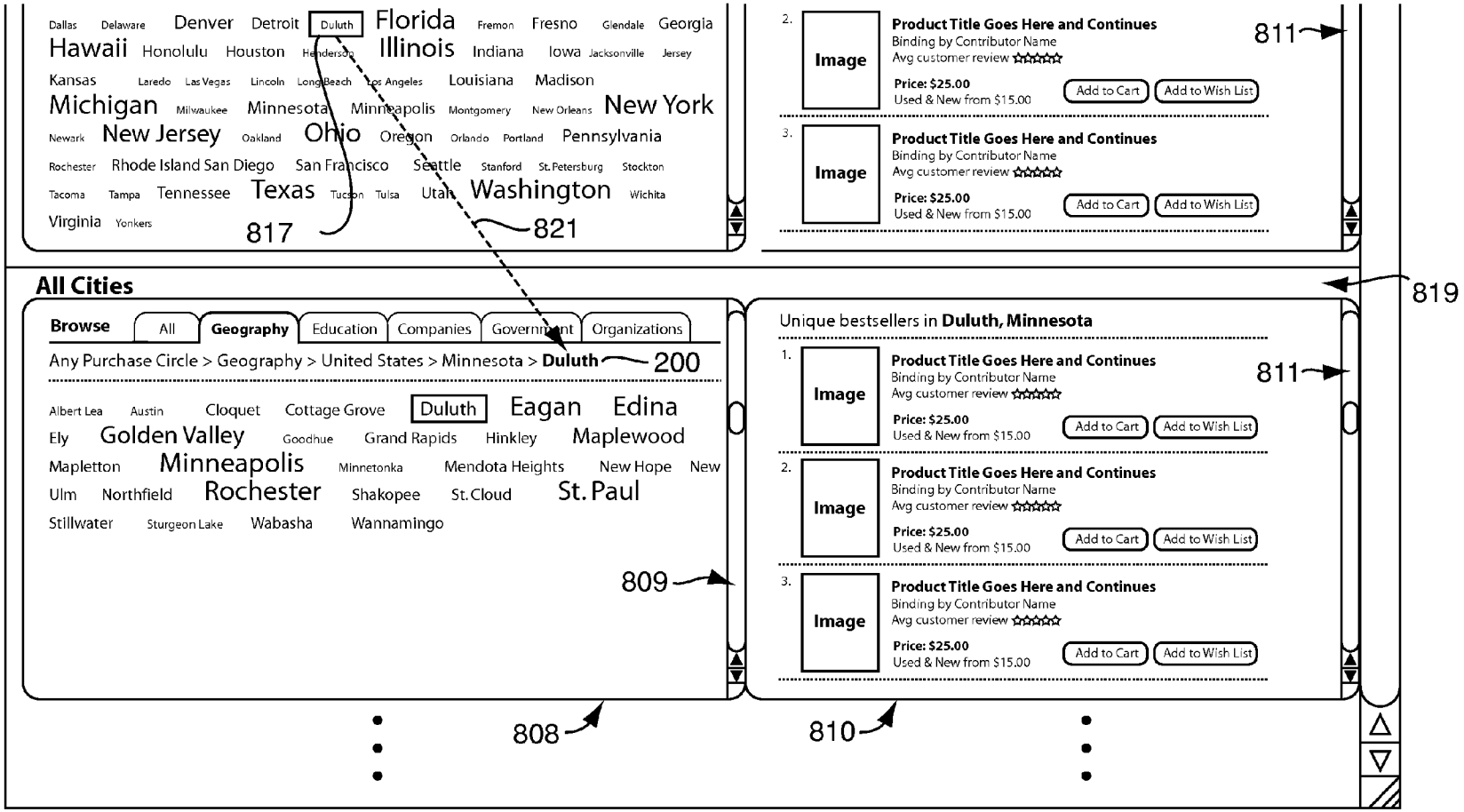

Referring to FIG. 13, in some embodiments, the text clouds and results lists may accumulate on the screen 100. In particular, a top level text cloud 800 and an adjacent results list section (or window) 802 (similar to the cloud 104 and results list 152 in FIG. 2) are provided in a first level screen section 803. The cloud 800 and results list 802 are selectable by the customer 10 as described hereinbefore. When the customer 10 selects a category, e.g., "United States", in the first level cloud 800, a box 805 appears around the selection and a new tag cloud 804 and corresponding results list 806 appears in a second level screen section 807 (similar to the cloud 104 and results list 214 in FIG. 3), below the first level screen section 803. In addition, the browse chain 200 discussed hereinbefore is displayed and an optional dashed arrow 815 shows the linkage between the first level cloud 800 and the second level cloud 804. When the customer 10 selects a category, e.g., "Duluth", in the cloud 804, a box 817 appears around the selection and a new tag cloud 808 and corresponding results list 810 appears in a third level screen section 807 (similar to the cloud 104 and results list 318 in FIG. 5), below the second level screen section 819. In addition, the browse chain 200 discussed hereinbefore is displayed and updated to show the browse path. An optional dashed arrow 821 shows the linkage between the second level cloud 804 and the third level cloud 808. Additional lower level screen sections continue to appear when a category selection is made until a leaf node is reached.

Further, any of the sections 803,807,819 displayed on the screen remain selectable by the customer 10. Thus, if the customer 10 selects a new category for a given section, the lower level sections are cleared and updated based on the selection made. For example, if the customer 10 selects the "Judicial Branch" category in the first level cloud 800 after the sections 803,807,819 are displayed, the sections 807 and 819 are then cleared and the section 807 is updated to display the updated text cloud and results list corresponding to the newly selected category "Judicial Branch". This is the case for any number of sections already displayed.

In addition, scroll bars 809,811 may be provided for each of the clouds 800,804,808 and results lists 802,806,810, respectively, if there are more results that the corresponding screen section allows. Further, a overall scroll bar 823 may be provided to allow the customer to scroll through the various levels of screen sections 803,807,819, as needed.

Figure 10:
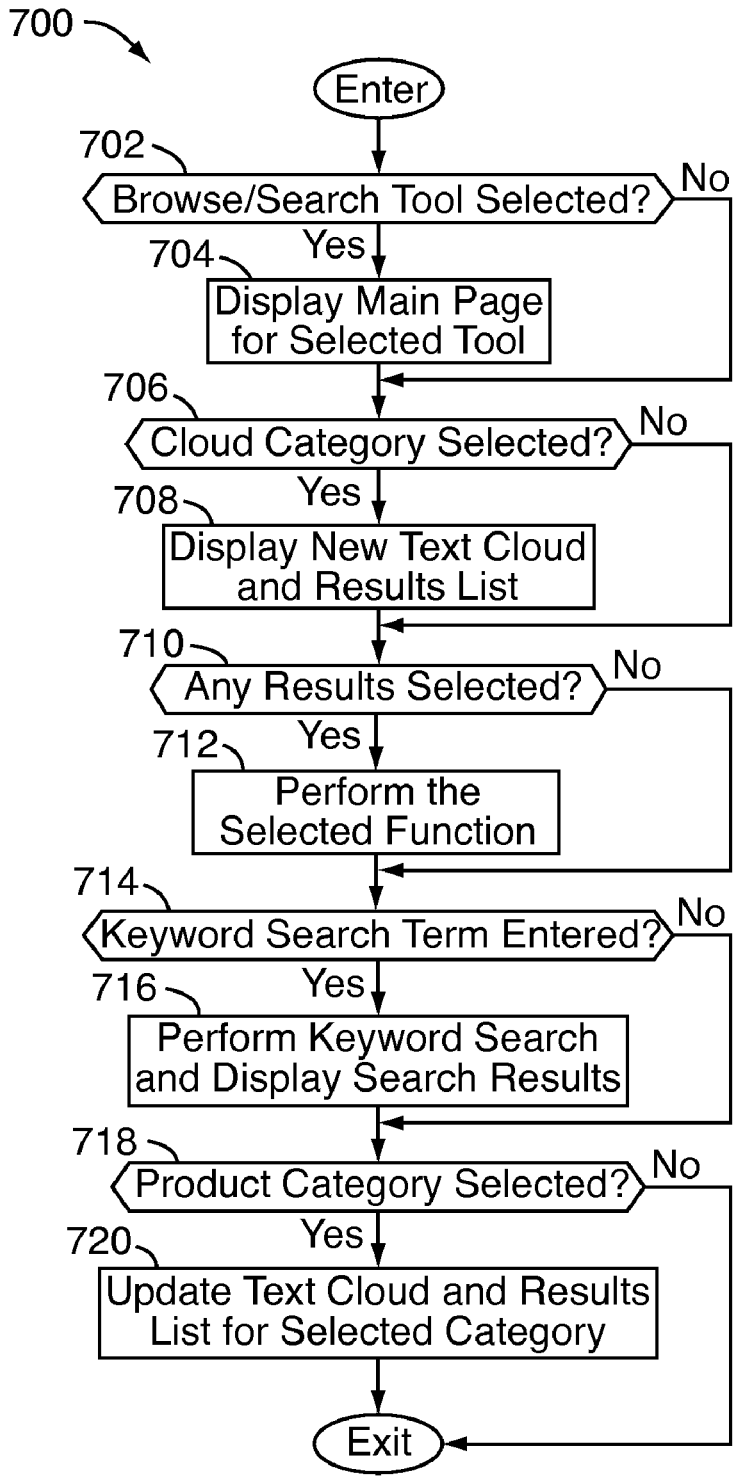
FIG. 10 is a flow chart of a text cloud navigation process, in accordance with embodiments of the present disclosure.

Referring to FIG. 10, a process 700 for providing the text cloud navigation discussed herein may start at a block 702, which determines if a browse/search tool has been selected. If yes, block 704 displays the main page 100 (FIG. 2) for the selected tool (e.g., bestsellers 112, new releases 114, popular searches 116, purchase circles 118, recommendations 120, etc.). After performing block 704 or if the result of block 702 is no, a block 706 determines if a category in a text cloud (FIGS. 2-5 & 13) has been selected. If yes, a block 708 displays a new text cloud and results list having categories based on the selected category, including displaying the first level child nodes of the selected category and selected lower level child nodes, displaying quantity identifiers, and only displaying nodes (or categories) meeting the minimum number of results threshold requirement, as discussed herein with FIGS. 2-5 & 13.

After performing block 708 or if the result of block 706 is no, a block 710 determines if any results have been selected in the results list 150 (FIGS. 2-5 & 13). If yes, a block 712 performs the requested function. In particular, if the image or title is selected, displays a product detail screen (not shown); if "add to cart" is selected, add item to cart; if "add to wish list" is selected, add item to customer's wish list; and the like. After performing block 712 or the result of block 710 is no, a block 714 determines if a keyword search term has been entered into the keyword search field 144 (FIGS. 2-7). If yes, a block 716 performs a keyword search and displays the search results list 402 as shown in FIG. 6. After performing block 716 or if the result of block 714 is no, a block 718 determines if a product category in the product category filter list 182 is selected (FIGS. 2-5). If yes, a block 720 updates the text cloud and results list for the selected category as discussed hereinbefore. After performing block 720 or if the result of block 718 is no, the process exits.

Figure 11:
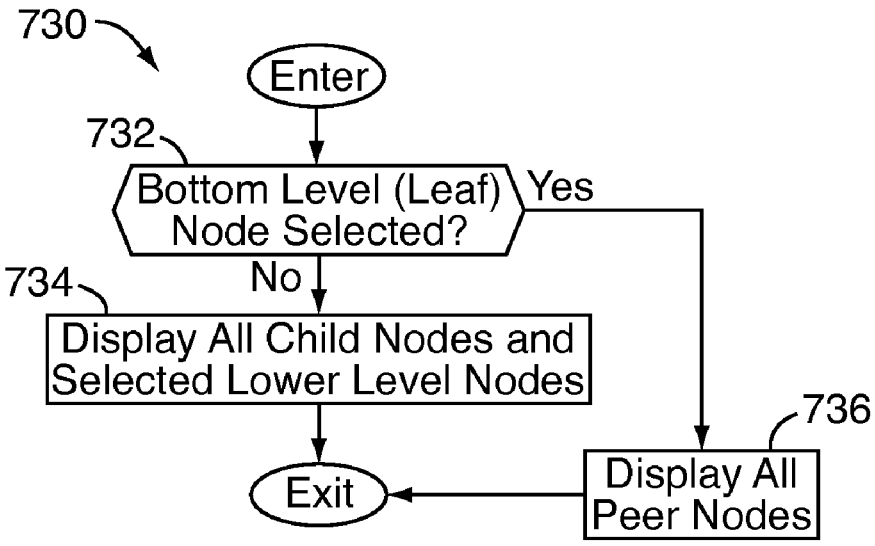
FIG. 11 is a flow chart of a text cloud navigation process, in accordance with embodiments of the present disclosure.

Referring to FIG. 11, a process 730 for updating the text clouds 104 (FIGS. 2-5, & 7), 800-808 (FIG. 13) when a category therein is selected, may begin at a block 732, which determines if the text cloud category selected has no child nodes and thus is a "leaf" node discussed hereinbefore. If not, a block 734 displays all child nodes and selected lower level nodes as discussed hereinbefore with FIG. 10 and the process exits. If the result of block 732 is yes, a block 736 displays all peer nodes and the process exits.

Figure 12:
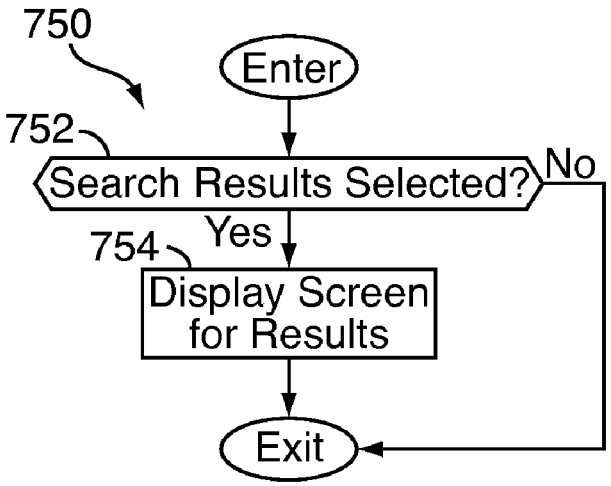
FIG. 12 is a flow chart of a text cloud navigation process, in accordance with embodiments of the present disclosure.

Referring to FIG. 12, a process 750 for responding to selected search results from the search results list 402 (FIG. 6) may begin at block 752, which determines if search results have been selected. If not, the process exits. If yes, a block 754 displays the applicable screen for the selected results, as discussed hereinbefore with FIG. 6. For example, if the results "Unique Bestsellers in United States" was selected, the system would display the screen 100 shown in FIG. 3.

As used herein, the term "list" includes, but is not limited to any list, group, set, or collection of two or more items. The items in a list may be displayed on one or more separate screens or web pages. The number of screens and the number of items on each screen depends on the format and content of the items and the customer web browser. The list may be in any format, including text and/or images, or any other format and it is not necessary that the items be displayed in any prioritized manner within the list or grouping, unless otherwise required as stated herein.

Furthermore, for any of the embodiments described herein, whenever the screen is updated in response to a customer 10 action or selection/deselection, it may be updated such that a new window (or screen section) is displayed within a currently displayed HTML (Hyper Text Markup Language) page, web page, or browser screen (and, thus, no new HTML page, web page, or browser screen is generated). Also, although the links discussed herein may link to another web page (or screen or window), according to some embodiments, the links may be buttons that, when selected, call for the display of corresponding information within the same web page (e.g. using a Flash, AJAX, or other interface that may not require redirection to another information page).

Although the disclosure has been described herein using exemplary techniques, algorithms, and/or processes for implementing the present disclosure, it should be understood by those skilled in the art that other techniques, algorithms and processes or other combinations and sequences of the techniques, algorithms and processes described herein may be used or performed that achieve the same function(s) and/or result(s) described herein and which are included within the scope of the present disclosure.

Any process descriptions, steps, or blocks in flow diagrams should be understood as potentially representing modules, segments, or portions of code which include one or more executable instructions for implementing specific logical functions or steps in the process, and alternate implementations are included within the scope of the preferred embodiments of the systems and methods of low-power computer operation in which functions may be deleted or executed out of order from that shown or discussed, including substantially concurrently or in reverse order, depending on the functionality involved, as would be understood by those reasonably skilled in the art.

It should be understood that, unless otherwise explicitly or implicitly indicated herein, any of the features, characteristics, alternatives or modifications described regarding a particular embodiment herein may also be applied, used, or incorporated with any other embodiment described herein. Also, the drawings herein are not drawn to scale.

Conditional language, such as, among others, "can," "could," "might," or "may," unless specifically stated otherwise, or otherwise understood within the context as used, is generally intended to convey that certain embodiments could include, but do not require, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Although the invention has been described and illustrated with respect to exemplary embodiments thereof, the foregoing and various other additions and omissions may be made therein and thereto without departing from the spirit and scope of the present disclosure.

At least the following is claimed:

1. A method, comprising:

causing the display of a first text cloud having a plurality of first categories on at least one computer display using at least one computer processor, each of said first categories having first results associated therewith and each of said first categories having a first quantity identifier indicative of a first number of said first results;

accepting the selection of one of said first categories as a selected first category; and causing, upon said selection of said selected first category, the display of a second text cloud having a representation of a plurality of first level child nodes being one level below said first selected category and a representation of a plurality of selected child nodes being at a level lower than said first level child nodes on the at least one computer display using the at least one computer processor, each of said first level child nodes and said selected child nodes having second results associated therewith and having a second quantity identifier indicative of a second number of said second results.

2. The method of claim 1, further comprising causing the display of a first results list listing said first results and a second results list listing said second results.

3. The method of claim 2 further comprising causing the display of a product category filter list, having a plurality of selectable product categories, and filtering said first and second results lists to contain results relating only to a selected product category.

4. The method of claim 1 further comprising accepting a keyword search term, performing a search of said first results for said search term, and causing the display of a search results list.

5. The method of claim 1, wherein the first text cloud emphasizes each of the first categories based on the first number of said first results, and wherein the second text cloud emphasizes each of the first level child nodes and each of the selected child nodes based on the second number of said second results.

6. A method, comprising:

causing the display of a plurality of first categories in a first text cloud on at least one computer display using at least one computer processor, each of said first categories having a first importance identifier associated therewith;

accepting the selection of one of said first categories as a selected first category; and causing, upon said selection of said selected first category, the display of a plurality of first level child nodes being one level below said selected first category and a plurality of selected child nodes being at a level lower than said first level child nodes in a second text cloud on the at least one computer display using the at least one computer processor, each of said first level child nodes and selected child nodes having a second importance identifier associated therewith.

7. The method of claim 6 wherein said first categories, said first level child nodes, and said selected child nodes each have results associated therewith.

8. The method of claim 7, further comprising causing the display of a results list listing said results.

9. The method of claim 8, further comprising accepting the selection of at least one of said results as selected results and allowing the purchase of an item associated with said selected results.

10. The method of claim 8 further comprising:

causing the display of a product category filter list, having a plurality of selectable product categories; and filtering said results list to contain results relating only to a selected product category from said selectable product categories.

11. The method of claim 7 wherein said first categories, said first level child nodes, and said selected child nodes, each have at least a predetermined number of said results.

12. The method of claim 7 further comprising:

accepting a keyword search term;

performing a search of said results for said keyword search term; and causing the display of a search results list indicative of results having said keyword search term.

13. The method of claim 6 wherein said first and second importance identifiers are indicative of at least one of: a number of results associated therewith, a relative importance, a similarity score, and a recommendations score.

14. The method of claim 6 wherein said first and second importance identifiers comprises a visual attribute of the display of said categories.

15. The method of claim 6 wherein said first and second importance identifiers comprises at least one of: text font size, text font style, text font color, background color, outline color, and images.

16. The method of claim 6 further comprising:

accepting the selection of one of said selected first level child nodes and said selected child nodes as a selected second category; and causing, upon said selection of said selected second category, the display of a plurality of another first level child nodes being one level below said selected second category and a plurality of another selected child nodes being at a level lower than said another first level child nodes.

17. The method of claim 6 wherein said selected child nodes are selected based on nodes useful to a customer.

18. The method of claim 6 wherein said selected child nodes are selected based on at least one of: location of customer, previous customer purchases, general customer interests, previous high ratings by a customer, and random selection.

19. The method of claim 6 further comprising causing, when said selected first category has no child nodes, the display of a plurality of second categories at the same level as the selected first category.

20. The method of claim 6, wherein the display of each of the first importance identifiers is determined based on a number of first level child nodes associated with each of said first categories.

21. A method performed by a computer system, comprising:

causing the display of a plurality of first categories in a first text cloud on at least one computer display using at least one computer processor, each of said first categories having a first importance identifier associated therewith;

accepting the selection of one of said first categories as a selected first category using at least one computer processor; and causing, upon said selection of said selected first category, the display of a plurality of first level child nodes being one level below said selected first category and a plurality of selected child nodes being at a level lower than said first level child nodes in a second text cloud on the at least one computer display, each of said first level child nodes and selected child nodes having a second importance identifier associated therewith.

22. A computer system having a computer comprising:

at least one computer processor, and a memory, wherein the computer is adapted to execute a computer program causing the computer system to perform a method comprising the steps of:

causing the display of a plurality of first categories in a first text cloud using the at least one computer processor, each of said first categories having a first importance identifier associated therewith;

accepting the selection of one of said first categories as a selected first category using the at least one computer processor; and causing, upon said selection of said selected first category, the display of a plurality of first level child nodes being one level below said selected first category and a plurality of selected child nodes being at a level lower than said first level child nodes in a second text cloud, each of said first level child nodes and said selected child nodes having a second importance identifier associated therewith using the at least one computer processor, wherein each of said first importance identifiers comprises a visual attribute of the display of said first categories in said first text cloud, and wherein each of said second importance identifiers comprises a visual attribute of the display of said first level child nodes and said selected child nodes in said second text cloud.

23. A non-transitory computer readable medium having a computer executable component for causing a computer system to perform a method, comprising:

causing the display of a plurality of first categories in a first text cloud on at least one computer display, each of said first categories having a first importance identifier associated therewith;

accepting the selection of one of said first categories as a selected first category using at least one computer processor; and causing, upon said selection of said selected first category, the display of a plurality of first level child nodes being one level below said selected first category and a plurality of selected child nodes being at a level lower than said first level child nodes in a second text cloud, each of said first level child nodes and said selected child nodes having a second importance identifier associated therewith on the at least one computer display, wherein each of said first importance identifiers and said second importance identifiers comprises at least one of text font size, text font style, text font color, background color, outline color, and images.

* * * * *